United States Patent [19]

Hirano et al.

[11] Patent Number: 5,047,316

[45] Date of Patent: Sep. 10, 1991

[54] SILVER HALIDE COLOR PHOTOGRAPHIC MATERIAL

[75] Inventors: Tsumoru Hirano; Kiyoshi Nakajyo, both of Kanagawa, Japan

[73] Assignee: Fuji Photo Film Co., Ltd., Minami-Ashigara, Japan

[21] Appl. No.: 462,559

[22] Filed: Jan. 9, 1990

[30] Foreign Application Priority Data

Jan. 10, 1989 [JP] Japan ..... 1-3470

[51] Int. Cl.[5] ..... G03C 1/04; G03C 7/34

[52] U.S. Cl. ..... 430/545; 430/546; 430/551; 430/552; 430/553

[58] Field of Search ..... 430/545, 551, 552, 553, 430/546

[56] References Cited

U.S. PATENT DOCUMENTS

| | | | |
|---|---|---|---|
| 4,358,533 | 11/1982 | Tokitou et al. | 430/512 |
| 4,567,134 | 1/1986 | Koboshi et al. | 430/372 |
| 4,725,530 | 2/1988 | Kobayashi et al. | 430/505 |

FOREIGN PATENT DOCUMENTS 0256531 2/1988 European Pat. Off. .

*Primary Examiner*—Charles L. Bowers, Jr.
*Assistant Examiner*—Janis L. Dote
*Attorney, Agent, or Firm*—Burns, Doane, Swecker & Mathis

[57] ABSTRACT

Disclosed is a silver halide color photographic material comprising a support having thereon at least one silver halide emulsion layer containing a cyan dye forming coupler and a polymer latex, the polymer latex is derived from a monomer represented by the following general formula (A):

(A)

wherein $R_1$ represents a hydrogen atom or an alkyl group having from 1 to 4 carbon atoms; $L_1$ represents —CONH— or p represents an integer of from 1 to 4; and q represents an integer of from 1 to 30.

The silver halide color photographic material provides a cyan color image without accompanying decrease in color density even when it is processed with an exhausted bleaching or bleach-fixing solution or a bleach or bleach-fixing solution having an weak oxidizing power. Further, the cyan color image is prevented from the occurrence of stain due to irradiation to light for a long period of time after processing.

Also, the polymer latex may contain, as a copolymer component, a repeating unit derived from a monomer represented by the following general formula (B):

(B)

wherein $R_2$ represents a hydrogen atom or an alkyl group having from 1 to 4 carbon atoms; $L_2$ represents —COO— or —CONH— or a phenyl group; $L_3$ represents —OCO—, —COO—, —NHCO— or —CONH—; $Y_1$ and $Y_2$ each represents a straight chain or branched chain alkylene group having from 1 to 12 carbon atoms; and h, i and j each represents 0 or 1, when j is 0, X represents a hydrogen atom or an alkali metal atom and when j is 1, X represents —COOH, —$SO_3H$, —OPO-$(OH)_2$ or a metal salt thereof.

22 Claims, No Drawings

SILVER HALIDE COLOR PHOTOGRAPHIC MATERIAL

FIELD OF THE INVENTION

The present invention relates to a silver halide color photographic material. More particularly, the present invention relates to a silver halide color photographic material which provides a cyan color image without accompanying decrease in color density, even when it is processed with a bleaching or bleach-fixing solution which is exhausted or has weak oxidizing power. Furthermore, staining of the cyan color image is prevented due to irradiation to light for a long periods of time after processing.

BACKGROUND OF THE INVENTION

When a silver halide color photographic material is imagewise exposed and then subjected to color development, an oxidized aromatic primary amine developing agent reacts with a dye forming coupler (hereinafter referred to as a "coupler") to form a color image.

Certain conditions are generally understood as being required for such couplers when used in silver halide color photographic materials. For example, they should have good stability, processing aptitude, and color forming properties, they should provide color images having good hue, and fastness; and they should be inexpensive and have good production aptitude.

Phenol type couplers and naphthol type couplers have been heretofore employed as cyan couplers. Particularly, 1-naphthol type couplers are widely employed in color negative photographic light-sensitive materials since dyes formed therefrom have an absorption maximum ($\lambda_{max}$) in a long wavelength region and less subsidiary absorption in a green region Thus, they are excellent in terms of color reproduction. In addition, these couplers have good color forming properties are inexpensive and have good production aptitude.

Unfortunately, widely employed phenol type couplers and naphthol type couplers, such as 2-alkylcarbamoyl 1-naphthol type couplers, do not provide color images having a sufficiently high density when photographic light-sensitive materials containing these couplers are processed in a bleaching or bleach-fixing step of color development processing using a bleaching or bleach-fixing solution, being exhausted or having a weak oxidation power. It is believed that this phenomenon occurs because of reduction fading of cyan dyes due to ferrous ions formed in the bleaching or bleach-fixing step. Furthermore, these couplers have poor fastness.

The aforementioned disadvantages with naphthol type couplers can be addressed by substituting an aryl group for an alkyl group in the substituent of the carbamoyl group on the 2-position to form 2-arylcarbamoyl-1-naphthol type couplers as described, for example, in U.S. Pat. No. 3,488,193. However, the latter disadvantage can not be wholly solved by using these arylcarbamoyl substituted couplers Therefore, it is not necessarily preferred to employ these couplers in light of the resulting poor preservability of the color image.

On the other hand, 1-naphthol type couplers including particular substituents on the 5-position such as those described in JP-A-60-237448, JP-A-61-179437 and JP-A-61-179438 (the term "JP-A" as used herein means an "unexamined published Japanese patent application") address the above-described disadvantages and provide excellent characteristics. Unfortunately, when photo graphic materials containing these couplers are irradiated with light for long periods of time after development processing, brown colored staining occurs. Such staining is undesirable for silver halide color photographic materials since it reduces the color reproducibility of color images and visual sharpness. In addition, there is an affect on the quality of the white background in the images.

Polymer latexes have been found to reduce the decrease in cyan density due to using exhausted bleaching or bleach-fixing solutions (See EP-A-0294104). Although such an effect is recognized, the disclosed latexes are basically ineffective for preventing staining.

SUMMARY OF THE INVENTION

An object of the present invention is to provide a silver halide color photographic material which is free from reduced cyan color density, even when it is processed with a bleaching or bleach-fixing solution being exhausted or having a weak oxidation power.

Another object of the present invention is to provide a silver halide color photographic material which avoids staining due to light irradiation for long periods of time after processing of the silver halide color photographic material.

While not specifically enumerated above, other objects of the present invention will become apparent from the following detailed description of the invention and the Examples.

These aforementioned objects of the invention are obtained using a silver halide color photographic material comprising a support having thereon at least one silver halide emulsion layer containing at least a cyan dye forming coupler and a polymer latex The polymer latex is derived from a monomer represented by the following general formula (A)

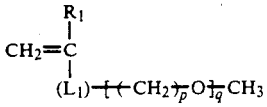

(A)

wherein $R_1$ represents a hydrogen atom or an alkyl group having from 1 to 4 carbon atoms; $L_1$ represents —CONH— or

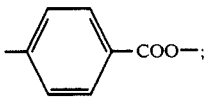

p represents an integer of from 1 to 4; and q represents an integer of from 1 to 30.

DETAILED DESCRIPTION OF THE INVENTION

The polymer latex according to the present invention may further contain, as a copolymer component, a monomer represented by the following general formula (B):

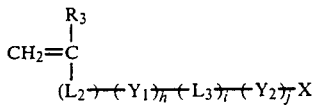

(B)

wherein $R_2$ represents a hydrogen atom or an alkyl group having from 1 to 4 carbon atoms; $L_2$ represents —COO— or —CONH— or a phenylene group; $L_3$ represents —OCO—, —COO—, —NHCO— or —CONH—; $Y_1$ and $Y_2$ each represents a straight chain or branched chain alkylene group having from 1 to 12 carbon atoms; and h, i and j each represents 0 or 1. However, when j is 0, X represents a hydrogen atom or an alkali metal atom and when j is 1, X represents —COOH, —$SO_3H$, —$OPO(OH)_2$ or a metal salt thereof, in addition to a monomer represented by the general formula (A).

Other monomers which do not disturb the formation of the copolymer latex, such as divinyl benzene, an alkyl acrylate, an alkyl methacrylate, an acrylamide, or a methacrylamide, may be employed as comonomer components.

In general formula (A), $R_1$ preferably represents a hydrogen atom or an alkyl group having from 1 to 4 carbon atoms, more preferably a hydrogen atom or a methyl group. $L_1$ represents —CONH— or

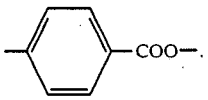

represents an integer of from 1 to 4, preferably from 1 to 3. q represents an integer of from 1 to 30, preferably from 1 to 10.

In general formula (B), $R_2$ represents a hydrogen atom or an alkyl group having from 1 to 4 carbon atoms, preferably a hydrogen atom or a methyl group. $L_2$ represents —COO—, —CONH— or a phenylene group. $L_3$ represents —OCO—, —COO—, —NHCO— or —CONH—, preferably —OCO— or —NHCO—. $Y_1$ and $Y_2$ each represents a straight chain or branched chain alkylene group having from 1 to 12 carbon atoms such as methylene, ethylene, propylene, pentylene, 2,2-dimethylpropylene, or decamethylene, preferably, methylene, ethylene, or propylene. The symbols h, i and j each represents 0 or 1. However when j is 0, X represents a hydrogen atom or an alkali metal atom (for example, sodium, or potassium), preferably a hydrogen atom. When j is 1, X represents —COOH, —$SO_3H$, —$OPO(OH)_2$ or a metal salt thereof (for example, sodium salt, or potassium salt), preferably —COOH or —$SO_3H$.

The polymer latex used in the present invention ordinarily can be prepared by an emulsion polymerization method. Emulsion polymerization initiators preferably used in the emulsion polymerization method include, for example, persulfates such as potassium persulfate or ammonium persulfate, azo compounds such as 4,4'-azobis(4-cyanovalerianic acid), peroxides such as benzoylperoxide, or hydrogen peroxide.

As emulsion polymerization aids, compounds having surface activity are employed. Preferred examples thereof include soap, sulfonates, sulfates, cation compounds, amphoteric compounds, and high molecular weight protective colloids.

The polymerization temperature is preferably ranges from 40 to 95° C.

The ratio of repeating units derived from the monomer represented by the general formula (A), in the polymer latex according to the present invention, is usually from 50 to 100% by weight, preferably from 70 to 100% by weight, and more preferably from 80 to 100% by weight.

The ratio of repeating units derived from the monomer represented by the general formula (B) in the polymer latex is usually from 0 to 30% by weight, preferably from 0 to 20% by weight, and more preferably from 2 to 10% by weight.

In the present invention, the polymer latex (polymer component) is employed in a range from 3 to 300% by weight, preferably from 10 to 250% by weight, and more preferably, from 20 to 200% by weight based on the coupler used in the present invention.

An aqueous solution of the polymer latex according to the present invention is mixed with an emulsified dispersion of the cyan coupler and a silver halide emulsion to prepare a coating solution.

Examples of the polymer latex used in the present invention is specifically illustrated below.

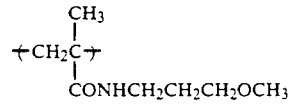

(P-1)

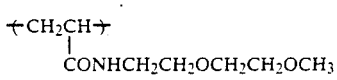

(P-2)

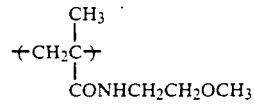

(P-3)

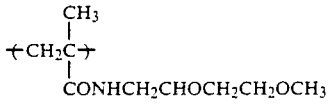

(P-4)

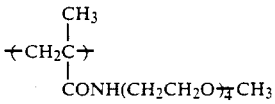

(P-5)

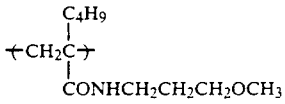

(P-6)

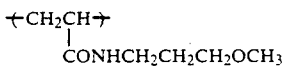

(P-7)

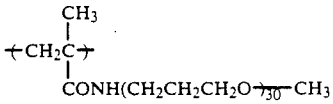

(P-8)

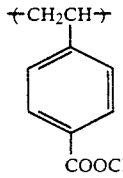

(P-9)

-continued
(P-10)
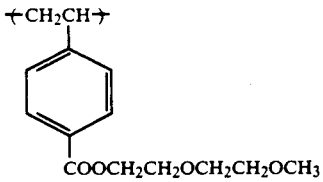
(P-11)
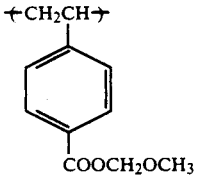
(P-12)
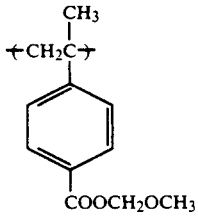
(P-13)
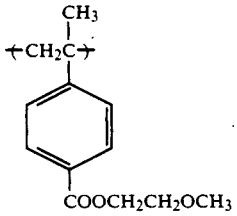
(P-14)
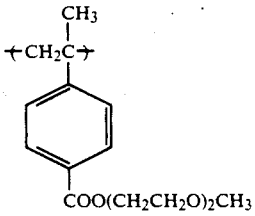
(P-15)
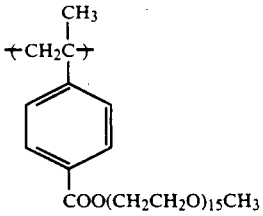
(P-16)
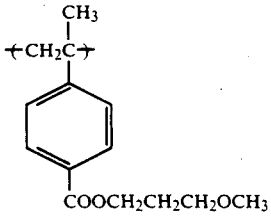
(P-17)
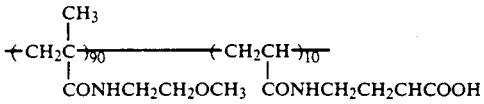
-continued
(P-18)
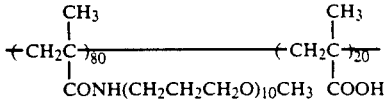
(P-19)
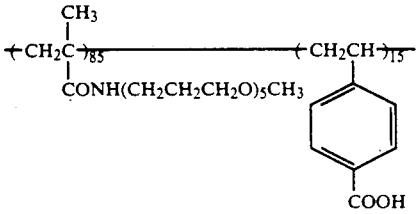
(P-20)
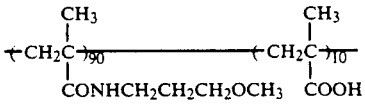
(P-21)
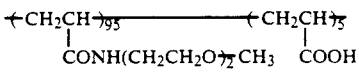
(P-22)
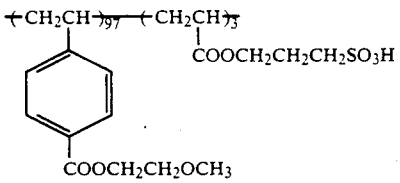
(P-23)
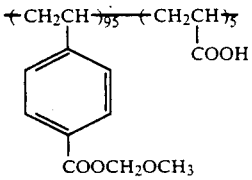
(P-24)
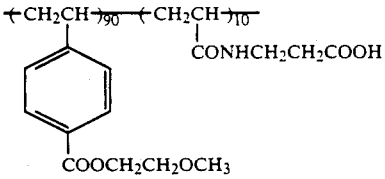
(P-25)
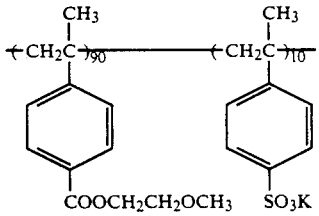
(P-26)
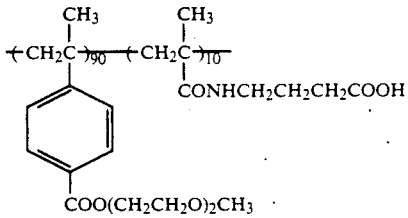

-continued

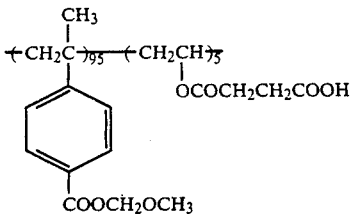

(P-27)

In the above, the ratio of comonomer components is indicated by a weight ratio.

Preferred cyan dye forming couplers which can be used in the present invention are naphthol-type and phenol-type couplers. One preferred example of the cyan coupler is the naphthol-type cyan coupler represented by the following general formula (I):

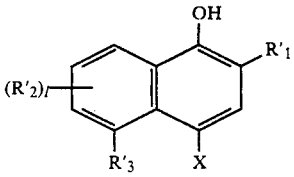

(I)

wherein $R'_1$ represents $—CONR_4R_5$, $—NHCOR_4$, $—NHCOOR_6$, $—NHSO_2R_6$, $—NHCONR_4R_5$ or $—NHSO_2NR_4R_5$ (wherein $R_4$ and $R_5$, which may be the same or different, each represents a hydrogen atom, an aliphatic group, an aromatic group or a heterocyclic group; and $R_6$ represents an aliphatic group, an aromatic group or a heterocyclic group); $R'_2$ represents a group capable of being substituted on the naphthalene ring, l represents an integer of from 0 to 3; $R'_3$ represents a hydrogen atom or a monovalent organic group; and X represents a hydrogen atom or a group capable of being released upon a coupling reaction with an oxidation product of an aromatic primary amine developing agent.

In the general formula (I), when l represents 2 or more, two or more $R'_2$ groups may be the same or different, or may combine with each other to form a ring. Furthermore, $R'_2$ and $R'_3$ or $R'_3$ and X may combine with each other to form a ring.

The coupler may also be a polymer including a dimer or more wherein the coupler moieties are connected with each other at the substituent represented by $R'_1$, $R'_2$, $R'_3$ or X through a di- or more valent group.

In the general formula (I), the aliphatic group includes a straight chain, branched chain or cyclic alkyl, alkenyl or alkynyl group which may be substituted or unsubstituted. The aromatic group denotes a substituted or unsubstituted aryl group which may include a condensed ring. The heterocyclic group denotes a substituted or unsubstituted, monocyclic or condensed heterocyclic group.

More preferably $R'_1$ represents $—CONR_4R_5$, $—NHCOR_4$, $—NHCOOR_6$, $NHSO_2R_6$, $—NHCONR_4R_5$ or $—NHSO_2NR_4R_5$ wherein the aliphatic group, aromatic group and heterocyclic group represented by $R_4$, $R_5$ or $R_6$ have from 1 to 30, from 6 to 30 and from 2 to 30 carbon atoms, respectively.

Preferably $R'_2$ represents a group or atom capable of being substituted on the naphthalene ring.

Typical examples of the substituents represented by $R'_2$ include a halogen atom, a hydroxy group, an amino group, a carboxy group, a sulfo group, a cyano group, an aromatic group, a heterocyclic group, a carbonamido group, a sulfonamido group, a carbamoyl group, a sulfamoyl group, a ureido group, an acyl group, an acyloxy group, an aliphatic oxy group, an aromatic oxy group, an aliphatic thio group, an aromatic thio group, an aliphatic sulfonyl group, an aromatic sulfonyl group, a sulfamoylamino group, a nitro group, and an imido group. The group represented by $R'_2$ preferably contains from 0 to 30 carbon atoms. Specific examples of $R'_2$ which form a ring when l is 2 include a dioxymethylene group.

Preferably $R'_3$ represents a hydrogen atom or a monovalent organic group wherein the monovalent organic group is represented by the following general formula (I-1):

$$R_7(Y)_m—NH— \quad (I\text{-}1)$$

wherein Y represents

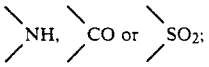

m represents 0 or 1; and $R_7$ represents a hydrogen atom, an aliphatic group having from 1 to 30 carbon atoms, an aromatic group having from 6 to 30 carbon atoms, a heterocyclic group having from 2 to 30 carbon atoms, $—OR_8$, $—COR_8$,

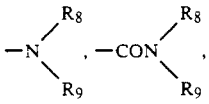

$—PO—(OR_{10})_2$, $—PO—(R_{10})_2$,

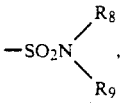

$—CO_2R_{10}$, $—SO_2R_{10}$ or $—SO_2OR_{10}$ wherein $R_8$, $R_9$ and $R_{10}$ each have the same meaning as defined for $R_4$, $R_5$ and $R_6$, respectively.

$R_4$ and $R_5$ in a moiety of a group represented by $R'_1$,

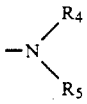

or $R_8$ and $R_9$ in

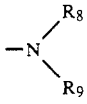

for $R_7$ may combine with each other to form a nitrogen-containing heterocyclic ring. Examples include morpholine, piperidine, and pyrrolidine rings.

X in the general formula (I) preferably represents a hydrogen atom or a coupling releasing group or coupling releasing atom. Typical examples of the coupling releasing group include a halogen atom, $$-OR',\ -SR',\ -\underset{\underset{O}{\|}}{OCR'},\ -NHCOR',\ -\underset{\underset{O}{\|}}{NHCSR'},\ -\underset{\underset{O}{\|}}{OCOR'},$$

$$-\underset{\underset{O}{\|}}{OCNHR'}$$

(wherein R' represents an aliphatic group having from 1 to 30 carbon atoms, an aromatic group having from 6 to 30 carbon atoms or a heterocyclic group having from 2 to 30 carbon atoms), an aromatic azo group having from 6 to 30 carbon atoms, or a heterocyclic group which has from 1 to 30 carbon atoms. The coupling releasing group is connected to the coupling active position of the coupler through a nitrogen atom such as succinimido, phthalimido, hydantoinyl, pyrazolyl, or 2-benzotriazolyl.

In the present invention, the aliphatic group may be a saturated or unsaturated, substituted or unsubstituted, straight chain, branched chain or a cyclic aliphatic group. Typical examples of the aliphatic groups include a methyl group, an ethyl group, a butyl group, a cyclohexyl group, an allyl group, a propargyl group, a methoxyethyl group, an n-decyl group, an n-dodecyl group, an n-hexadecyl group, a trifluoromethyl group, a heptafluoropropyl group, a dodecyloxypropyl group, a 2,4-di-tert-amylphenoxypropyl group, or a 2,4-di-tert-amylphenoxybutyl group.

The aromatic group may be a substituted or unsubstituted aromatic group. Typical examples of the aromatic groups include a phenyl group, a tolyl group, a 2-tetradecyloxyphenyl group, a pentafluorophenyl group, a 2-chloro-5-dodecyloxycarbonylphenyl group, a 4-chlorophenyl group, a 4-cyanophenyl group, or a 4-hydroxyphenyl group.

The heterocyclic group may be a substituted or unsubstituted heterocyclic group. Typical examples of the heterocyclic groups include a 2-pyridyl group, a 4-pyridyl group, a 2-furyl group, a 4-thienyl group, or a quinolyl group.

$R'_1$ is most preferably $-CONR_4R_5$. Examples include carbamoyl, ethylcarbamoyl, morpholinocarbonyl, dodecylcarbamoyl, hexadecylcarbamoyl, decyloxypropyl, dodecyloxypropyl, 2,4-di-tert-amylphenoxypropyl, or 2,4-di-tert-amylphenoxybutyl groups.

With respect to $R'_2$ and l, it is most preferred that l is 0, i.e., that is, $R'_2$ is not a substituent. Alternatively, a halogen atom, an aliphatic group, a carbonamido group or a sulfonamido group is a suitable substituent for $R'_2$.

$R'_3$ is preferably a group represented by the general formula (I-1) wherein m represents 0 and $R_7$ represents a $-COR_8$ group such a a formyl, acetyl, trifluoroacetyl, chloroacetyl, benzoyl, pentafluorobenzoyl, or p-chlorobenzoyl group, a $-COOR_{10}$ group such as a methoxycarbonyl, ethoxycarbonyl, butoxycarbonyl, decyloxycarbonyl, methoxyethoxycarbonyl, or phenoxycarbonyl group, a $-SO_2R_{10}$ group such as a methanesulfonyl, ethanesulfonyl, butanesulfonyl, hexadecanesulfonyl, benzenesulfonyl, toluenesulfonyl, or p-chlorobenzenesulfonyl group, a $-CONR_8R_9$ group such as an N,N-dimethylcarbamoyl, N,N-diethylcarbamoyl, N,N-dibutylcarbamoyl, morpholino carbonyl, piperidinocarbonyl, 4-cyanophenylcarbamoyl, 3,4-dichlorophenylcarbamoyl, or 4-methanesulfonylphenylcarbamoyl group or a $-SO_2NR_8R_9$ group such as an N,N-dimethylsulfamoyl, N,N-diethylsulfamoyl, or N,N-dipropylsulfamoyl group.

Particularly preferred groups for $R'_3$ are $-NHCOOR_{10}$, $-NHCOR_8$ or $-NHSO_2R_{10}$. Among these, $-NHCOOR_{10}$ is most preferred.

X is preferably a hydrogen atom, a chlorine atom, an aliphatic oxy group such as a 2-hydroxyethoxy, 2-chloroethoxy, carboxymethyloxy, 1-carboxyethoxy, 2methanesulfonylethoxy, 3-carboxypropyloxy, 2-methoxycarboxytridecylthio)ethyloxy, 2 carboxymethylthioethyloxy, or 2-methanesulfonamidoethyloxy group, an aromatic oxy group such as a 4-acetamidophenoxy, 2-acetamidophenoxy, or 4-(3-carboxypropanamido)phenoxy group, or a carbamoyloxy group such as an ethylcarbamoyloxy or phenylcarbamoyloxy group.

The coupler represented by general formula (I) may be a polymer including a dimer or more by connecting each other through a di- or more valent group at the substituent represented by $R'_1$, $R'_2$, $R'_3$ or $X_1$ respectively. In such cases, the range of carbon atoms defined for each substituent above may not be restricted.

Typical examples of polymer couplers formed from the coupler represented by the general formula (I) are a homopolymer and a copolymer each containing a unit of addition-polymerizable ethylenically unsaturated compound having a cyan dye forming coupler residue (a cyan color forming monomer).

Specific examples of the cyan coupler represent ed by the general formula (I) are described, for example, in JP-A-60-237448, JP-A-61-145557, JP-A-61-153640 and JP-A-62-121457.

Another preferred example of the cyan coupler used in the present invention is a phenol-type cyan coupler having an arylureido group at the 2-position thereof and an acylamino group at the 5-position thereof which can be represented by the following general formula (II):

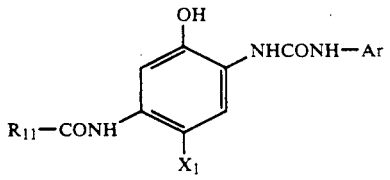

(II)

In the above formula, $R_{11}$ represents an aliphatic group, an aromatic group or a heterocyclic group; Ar represents an aromatic group; and $X_1$ represents a hydrogen atom or a group capable of being released upon a coupling reaction with an oxidation product of an aromatic primary amine developing agent.

In general formula (II), the aliphatic group means an aliphatic hydrocarbon group (hereinafter the aliphatic group means the same) and includes a straight chain, branched chain or cyclic alkyl, alkenyl or alkynyl group which may be substituted or unsubstituted. The aromatic group denotes a substituted or unsubstituted aryl group which may include a condensed ring. The heterocyclic group denotes a substituted or unsubstituted, monocyclic or condensed heterocyclic group.

$R_{11}$ in general formula (II) represents an aliphatic group preferably having from 1 to 36 carbon atoms, an aromatic group preferably having from 6 to 36 carbon atoms or a heterocyclic group preferably having from 2 to 36 carbon atoms. More preferred examples of $R_{11}$ include a tertiary alkyl group having from 4 to 36 carbon atoms or a group having from 7 to 36 Carbon atoms represented by the following general formula (II-1):

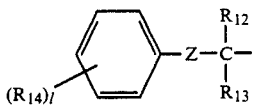

(II-1)

In the above formula, $R_{12}$ and $R_{13}$, which may be the same or different, each represent a hydrogen atom, an aliphatic group having from 1 to 30 carbon atoms or an aromatic group having from 6 to 30 carbon atoms; $R_{14}$ represents a monovalent group; Z represents —O—, —S—, represents a monovalent group; Z represents —O—, —S—, —SO— or —$SO_2$—; and l represents an integer of from 0 to 5, when l represents an integer of 2 or more, two or more $R_{14}$ groups may be the same or different.

In a preferred embodiment, $R_{12}$ and $R_{13}$ each represent a straight chain or branched chain alkyl group having from 1 to 18 carbon atoms, $R_{14}$ represents a group having from 0 to 30 carbon atoms including a halogen atom, an aliphatic group, an aliphatic oxy group, a carbonamido group, a sulfonamido group, a carboxy group, a sulfo group, a cyano group, a hydroxy group, a carbamoyl group, a sulfamoyl group, an aliphatic oxycarbonyl group and an aromatic sulfonyl group, Z represents —O—, and l represents an integer of from 1 to 3.

Ar in the general formula (II) represents a substituted or unsubstituted aryl group which may include a condensed ring. Typical examples of substituents for the aryl group represented by Ar include a halogen atom, a cyano group, a nitro group, a trifluoromethyl group, —$COOR_{15}$, —$COR_{15}$, —$SO_2OR_{15}$, —$NHCOR_{15}$,

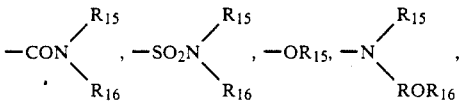

—$SO_2R_{17}$, —$SOR_{17}$, —$OCOR_{17}$, and

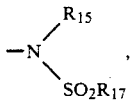

wherein $R_{15}$ and $R_{16}$, which may be the same or different, each represent a hydrogen atom, an aliphatic group, an aromatic group or a heterocyclic group; and $R_{17}$ represents an aliphatic group, an aromatic group or a heterocyclic group. The number of carbon atoms included in Ar is preferably from 6 to 30. A phenyl group substituted with one or more of the above described substituents is preferred for Ar.

$X_1$ in general formula (II) represents a hydrogen atom or a coupling releasing group or a coupling releasing atom (hereinafter, a coupling releasing group also includes a coupling releasing atom). Representative examples of the coupling releasing groups include a halogen atom, —$OR_{18}$, $SR_{18}$,

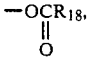

—$NHCOR_{18}$,

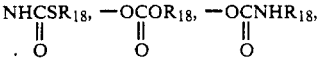

an aromatic azo group having from 6 to 30 carbon atoms, or a heterocyclic group which is connected to the coupling active position of the coupler through a nitrogen atom and has 1 to 30 carbon atoms such as succinimido, phthalimido, hydantoinyl, pyrazolyl, or 2-benzotriazolyl groups. In the above formulae, $R_{18}$ represents an aliphatic group having from 1 to 30 carbon atoms, an aromatic group having from 6 to 30 carbon atoms or a heterocyclic group having from 2 to 30 carbon atoms.

Specific examples of the aliphatic group, aromatic group and heterocyclic group above are same as those described in the general formula (I) hereinbefore.

The coupler represented by the general formula (II) may form a polymer including a dimer, an oligomer or more by connecting each other through a di- or more valent group at the substituent represented by $R_{11}$, Ar or $X_1$. Specific examples of the cyan coupler represented by the general formula (II) are described, for example, in U.S. Pat. Nos. 4,333,999, 4,451,559, 4,444,872, 4,427,767, 4,609,619 and 4,579,813, European Patent 067,689 and JP-A-61-42658.

Still other preferred examples of the cyan coupler which can be used in the present invention are -acylamino-type phenolic cyan couplers and a 2,5-diacylamino type phenolic cyan couplers. These can be represented by the following general formulae (III) and (IV), respectively:

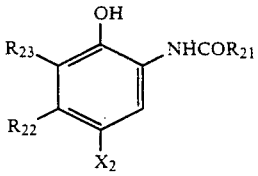

(III)

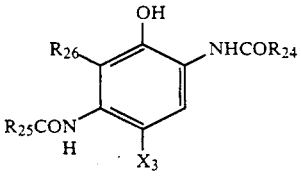

(IV)

In the above formulae, $R_{21}$, $R_{24}$ and $R_{25}$ each represent an aliphatic group, an aromatic group, a heterocyclic group, or a heterocyclic amino group; $R_{22}$ represents an aliphatic group; $R_{23}$ and $R_{26}$ each represent a hydrogen atom, a halogen atom, an aliphatic group, an aliphatic oxy group or an acylamino group; and $X_2$ and $X_3$ each represent a hydrogen atom or a group capable of being released upon a coupling reaction with an oxidation product of a developing agent (hereinafter referred to a "releasing group").

In the general formula (III) or (IV), $R_{22}$ and $R_{23}$ or $R_{25}$ and $R_{26}$ may combine with each other to form a 5-membered, 6-membered or 7-membered ring.

Furthermore, a polymer including a dimer or more may be formed at the substituent represented by $R_{21}$, $R_{22}$, $R_{23}$ or $X_2$, or $R_{24}$, $R_{25}$, $R_{26}$ or $X_3$.

The aliphatic group described above includes a straight chain, branched chain or cyclic alkyl, alkenyl or alkynyl group.

Preferred examples of $R_{21}$ in the general formula (III) or $R_{25}$ in the general formula (IV) include a substituted or unsubstituted alkyl group and a substituted or unsubstituted aryl group. As the substituent for the alkyl group, a phenoxy group which may be substituted or a halogen atom is particularly preferred. As the substituent for the phenoxy group, an alkyl group, an alkoxy group, a halogen atom, a sulfonamido group or a sulfamido group is more preferred. Of the aryl groups, aryl groups substituted with at least one of the substituents selected from a halogen atom, an alkyl group, a sulfonamido group and an acylamino group, are particularly preferred.

Preferred examples of $R_{24}$ in general formula (IV) include a substituted alkyl group and a substituted or unsubstituted aryl group. As the substituent for the alkyl groups, a halogen atom is particularly preferred. Of the aryl groups, a phenyl group or a phenyl group substituted with at least one of the substituents selected from a halogen atom and a sulfonamido group is particularly preferred.

Preferred examples of $R_{22}$ in general formula (III) include an alkyl group having from 1 to 20 carbon atoms which may be substituted. Preferred examples of the substituents for $R_{22}$ include an alkyloxy group, an aryloxy group, an acylamino group, an alkylthio group, an arylthio group, an imido group, a ureido group, an alkylsulfonyl group and an arylsulfonyl group.

Preferred examples of $R_{23}$ in general formula (III) include a hydrogen atom, a halogen atom (preferably, a fluorine atom or a chlorine atom) and an acylamino group. Among these, a halogen atom is particularly preferred.

Preferred examples of $R_{26}$ in general formula (IV) include a hydrogen atom, an alkyl group having from 1 to 20 carbon atoms and an alkenyl group. A hydrogen atom is particularly preferred.

$R_{25}$ and $R_{26}$ in general formula (IV) preferably form a 5-membered or 6-membered nitrogen-containing heterocyclic ring.

$R_{22}$ in the general formula (III) is more preferably an alkyl group having from 2 to 4 carbon atoms.

$X_2$ and $X_3$ in the general formulae (III) and (IV) each preferably represent a halogen atom, more preferably a chlorine atom.

The cyan couplers represented by the general formula (III) or (IV) may be employed individually or in a combination of two or more thereof.

Suitable examples of the phenol-type cyan couplers include those having an acylamino group at the 2-position of the phenol nucleus and an alkyl group at the 5-position thereof (including polymer couplers) described, for example, in U.S. Pat. Nos. 2,369,929, 4,518,687, 4,511,647 and 3,772,002. Representative specific examples thereof include the couplers described in Canadian Patent No. 625,822, Compound (1) described in U.S. Pat. No. 3,772,002, the compounds described in U.S. Pat. No. 4,564,590, the compounds described in JP-A-61-39045, and the compound described in JP-A-62-70846.

Suitable examples of the phenol-type cyan couplers include 2,5-diacylamino-substituted phenol type couplers described, for example, in U.S. Pat. Nos. 2,772,162, 2,895,826, 4,334,011 and 4,500,635, and JP-A59-164555. Representative specific examples thereof include the compounds described in U.S. Pat. No. 2,895,826, the compounds described in U.S. Pat. No. 4,557,999, the compounds described in U.S. Pat. No. 4,565,777, the compounds described in U.S. Pat. No. 4,124,396, and the compounds described in U.S. Pat. No. 4,613,564.

Other suitable examples of phenol-type cyan couplers include those wherein a nitrogen-containing heterocyclic ring is condensed on the phenol nucleus such as those described in U.S. Pat. Nos. 4,327,173, 4,564,586 and 4,430,423, JP-A-61-390441 and JP-A-62-257158. Representative specific examples thereof include the couplers described in U.S. Pat. No. 4,327,173, the compounds described in U.S. Pat. No. 4,564,586, the compounds described in U.S. Pat. No. 4,430,423, and the compounds illustrated below.

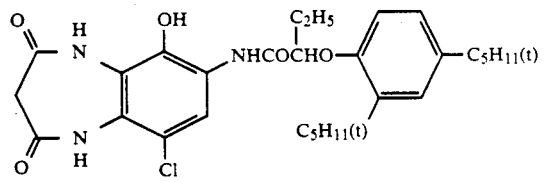

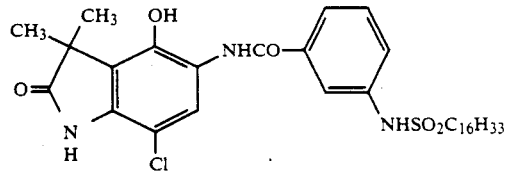

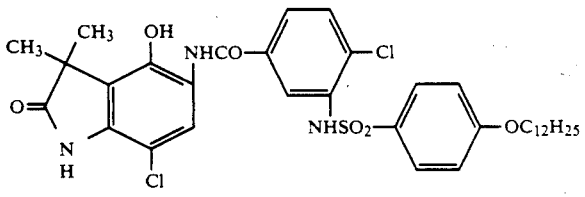

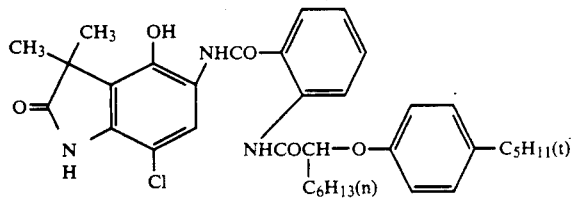

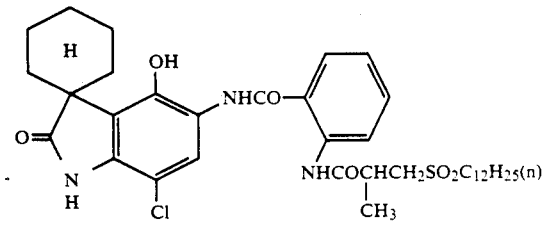

-continued

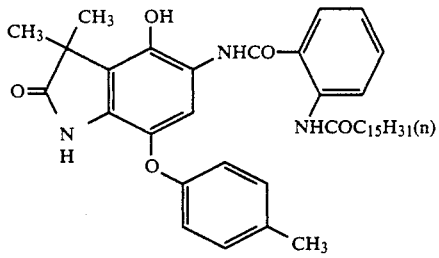

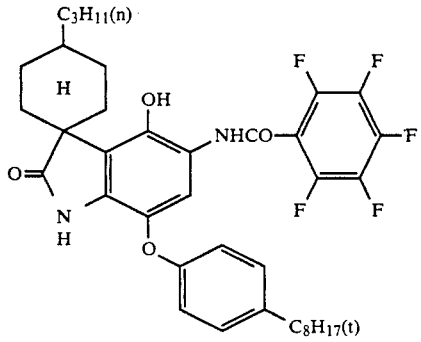

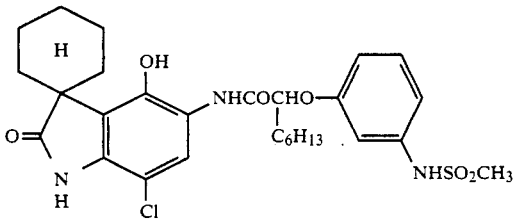

A standard amount of the cyan coupler which can be used in the present invention ranges from 0.001 mol to 1 mol, preferably from 0.005 mol to 0.5 mol, per mol of light-sensitive silver halide present in the same layer.

Furthermore, the cyan coupler used according to the present invention can be employed together with DIR couplers or DIR compounds which release a development inhibitor during the course of coupling reaction, BAR couplers or BAR compounds which release a bleach accelerating agent, or DAR couplers or DAR compounds which release a development accelerating agent.

In the color photographic light-sensitive material according to the present invention, a yellow coupler and a magenta coupler which form yellow and magenta colors upon coupling with an oxidation product of an aromatic amine-type color developing agent, respectively, are usually employed, in addition to the above-described cyan coupler which form cyan color.

Of yellow couplers usable in the present invention, acylacetamido derivatives such as benzoylacetanilide and pivaloylacetanilides are preferred. Among those, those represented by the general formula (Y-1) or (Y-2) shown below are more preferred as yellow couplers.

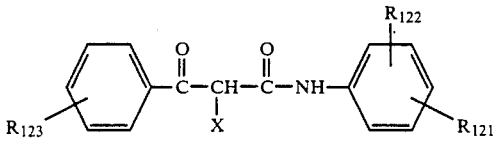

(Y-1)

-continued

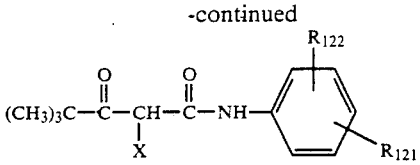

(Y-2)

In the above formulae, X represents a hydrogen atom or a group capable of being released upon coupling; $R_{121}$ represents a diffusion resistant group having from 8 to 32 carbon atoms in total; $R_{122}$ represents a hydrogen atom, one or more of halogen atoms, lower alkyl groups, lower alkoxy groups or diffusion resistant groups having from 8 to 32 carbon atoms in total; and $R_{123}$ represents a hydrogen atom Or a substituent, when two or more $R_{123}$ groups are present, they may be the same or different.

The pivaloylacetanilide type yellow couplers are described in detail, for example, in U.S. Pat. No. 4,622,287, in column 3, line 15 to column 8, line 39, and U.S. Pat. No. 4,623,616, column 14, line 50 to column 19, line 41.

The benzoylacetanilide type yellow couplers are described in detail, for example, in U.S. Pat. Nos. 3,408,194, 3,933,501, 4,046,575, 4,133,958 and 4,401,752.

Preferred specific examples of pivaloylacetanilide-type yellow couplers are those described in U.S. Pat. No. 4,622,287, at column 37 to column 54.

Furthermore, the compounds (Y-1) to (Y-33) described in U.S. Pat. No. 4,623,616, at column 19 to column 24 are preferred.

Moreover, the compounds described in U.S. Pat. No. 3,408,194, at column 6; the compounds described in U.S. Pat. No. 3,933,501, at column 8; the compounds described in U.S. Pat. No. 4,046,575, at column 7 to column 8; the compounds described in U.S. Pat. No. 4,133,958, at column 5 to column 6; and the compounds described in U.S. Pat. No. 4,401,752, at column 5 are also preferred.

Examples of magenta couplers usable in the present invention include oil protected indazolone-type couplers and cyanoacetyl-type couplers, preferably 5-pyrazolone-type couplers and pyrazoloazole-type couplers such as pyrazolotriazoles. Of 5-pyrazolone-type couplers, those substituted with an arylamino group or an acylamino group at the 3-position thereof are preferred in view of hue and color density of the dyes formed. Typical examples thereof are described in U.S. Pat. Nos. 2,311,082, 2,343,703, 2,600,788, 2,908,573, 3,062,563, 3,152,896, and 3,936,015. The two-equivalent 5-pyrazolone-type couplers containing nitrogen atom-releasing groups described in U.S. Pat. No. 4,310,619 and those having arylthio groups described in U.S. Pat. No. 4,351,897 and WO-88-4795, as releasing groups are preferred. Furthermore, 5-pyrazolone-type couplers having the ballast group described in European Patent No. 73,636 are advantageous because they provide high color density.

Examples of pyrazoloazole-type couplers include pyrazolobenzimidazoles such as those described in U.S. Pat. No. 2,369,879, and preferably pyrazolo[5,1c][1,2,4]-triazoles such as those described in U.S. Pat. No. 3,725,067, pyrazolotetrazoles such as those described in Research Disclosure, No. 24220 (June, 1984), and pyrazolopyrazoles such as those described in Research Disclosure, No. 24230 (June, 1984). The above described couplers may be in the form of polymer couplers.

These compounds are specifically represented by the following general formula (M-1), (M-2) or (M-3):

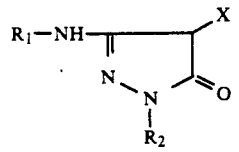

(M-1)

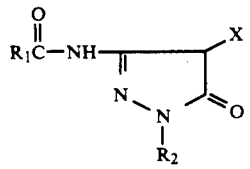

(M-2)

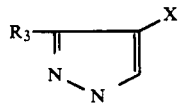

(M-3)

Z

In the above formula, $R_1$ represents a diffusion resistant group having from 8 to 32 carbon atoms in total; $R_2$ represents a phenyl group or a substituted phenyl group; $R_3$ represents a hydrogen atom or a substituent; Z represents a non-metallic atomic group necessary to from a 5-membered azole ring containing from two to four nitrogen atoms, which azole ring may have one or more substituents (including a condensed ring); and X represents a hydrogen atom or a group capable of being released.

Suitable substituents for $R_2$ and the substituents on the azole ring are described in detail in U.S. Pat. No. 4,540,654, at column 2, line 41 to column 8, line 27.

Among the pyrazoloazole-type couplers, imidazo[1,2-b]pyrazoles such as those described in U.S. Pat. No. 4,500,630 are preferred, and pyrazolo[1,5-c][1,2,4]triazoles such as those described in U.S. Pat. No. 3,725,067 and JP-B-47-27411 (the term "JP-B" as used herein means an "examined Japanese patent publication"), and pyrazolo[1,5-b][1,2,4]triazoles such as those described in U.S. Pat. No. 4,540,654, JP-A59-171956 and JP-A-60-172982 are particularly preferred in view of less yellow subsidiary absorption and light fastness of the dyes formed.

In addition, pyrazolotriazole couplers wherein a branched chain alkyl group is directly connected to the 2-, 3- or 6-position of the pyrazolotriazole ring such as those described in JP-A-61-65245, pyrazoloazole couplers containing a sulfonamido group in their molecules such as those described in JP-A-61-65246, pyrazoloazole couplers having an alkoxyphenylsulfonamido ballast group such as those described in JP-A-61-147254, and pyrazolotriazole couplers having an alkoxy group or an aryloxy group at the 6-position thereof such as those described in European Patent Application (OPI) No. 226,849 are preferably employed.

The cyan, magenta and yellow couplers described - solvent above are preferably dissolved in an organic having a high boiling point. Then, the resulting solution is emulsified or dispersed in an aqueous solution of gelatin.

Suitable examples of organic solvents having a high boiling point include those described in JP-A-62-215272, from page 137, right lower column to page 144, right upper column.

Examples of high boiling organic solvent include phthalates (e.g., dibutylphthalate, dicyclohexylphthalate, di-2-ethylhexylphthalate, decylphthalate, bis(2,4-di-t-amylphenyl)phthalate, bis(2,4-di-t-amylphenyl-)isophthalate, bis(1,1-diehylpropyl)phthalate, etc.), phosphates or phosphonates (e.g., triphenylphosphate, tricresylphosphate, 2-ethylhexyldiphenylphosphate, tricyclohexyl phosphate, tri-2-ethylhexylphosphate, tridodecylphosphate, tributoxyethyl-phosphate, trichloropropylphosphate, di-2-ethylhexylphenylphosphate, etc.), bazoate 9e.g., 2-ethylhexylbenzoate, dodecylbenzoate, 2-ethylhexyl-p-hydroxybenzoate, etc.), amides (e.g., N,N-diethyldodecaneamide, N,N-diethyllaurylamide, N-tetradecylpyrrolidone, etc.), alcohols or phenols (e.g., isostearylalcohol, 2,4-di-tert-amylphenol, etc.), aliphatic carboxylic acid esters (e.g., bis(2-ethylhexyl)sebacate dioctylazelate, glyceroltributyrate, isostearyllactate, trioctylcitrate, etc.), aniline derivatives (e.g., N,N-dibutyl 2-butoxy-5-tert-octylaniline, etc.), hydrocarbons (e.g., paraffine, dodecylbenzene, diisopropylnaphthalene, etc.)

Furthermore, polymer couplers can be mixed with a silver halide emulsion in the form of an aqueous polymer latex solution.

Together with the cyan coupler used according to the present invention, a yellow coupler or a magenta coupler, a color formation reinforcing agent may be employed in order to increase a color forming property of the coupler. The use of such a compound is particularly preferred in case of processing with a color developing solution which does not contain benzyl alcohol. Structures and specific examples of the color formation reinforcing agents are described in JP-A-62-215272, at pages 121 to 125.

For the silver halide emulsion layer of the color photographic material according to the present invention, any of silver bromide, silver iodobromide, silver iodochlorobromide, silver chlorobromide, and silver chloride may be used as the silver halide.

For purposes of conducting rapid processing, silver chlorobromide containing 90 mol% or more, more preferably 98 mol% or more of silver chloride is preferred. Although such silver chlorobromide may contain a slight amount of silver iodide, it is preferred that it does not contain any silver iodide.

There is no particular restriction on the average grain size of the silver halide grains in the photographic emulsion; the grain size being defined as the diameter of the grain when the grain has a spherical or a nearly spherical form and as the length of the edge when the grain has a cubic form, and being averaged based on projected area of the grains. However, it is preferred that the grain size is not more than 2 μm, and particularly from 0.2 μm to 1.5 μm.

The silver halide grains in the photographic emulsion layer may have a regular crystal form such as cubic, tetradecahedral, or octahedral, or an irregular crystal form such as spherical, or tabular, or may have a composite form of these crystal forms. Also, a mixture of grains having various crystal forms may be used. Of these emulsions, the use of a photographic emulsion of regular crystal form is preferred.

Furthermore, a silver halide emulsion wherein tabular silver halide grains having a diameter at least 5 times the thickness thereof accounts for at least 50% of the total projected area of the silver halide grains, may be used in the present invention.

A silver halide emulsion employed at least one layer of the light-sensitive layers is preferably a monodispersed silver halide emulsion having a coefficient of variation of not more than 15%, more preferably not more than 10%. The coefficient of variation is a value which is obtained by dividing a statistical standard deviation with an average grain size and is indicated in terms of a percent.

Such a monodispersed emulsion may be a single emulsion having the coefficient of variation described above, or an emulsion composed of a mixture of two or more types of monodispersed emulsions prepared separately and having different average grain sizes and each having the coefficient of variation of not more then 15%, preferably not more than 10%. The difference in grain size and the mixing ratio of these monodispersed emulsions to be mixed can be appropriately selected. However, emulsions having the difference in average grain size ranging from not less than 0.2 μm to not more than 1.0 μm are preferably employed.

The definition as to the coefficient of variation and the methods of measurement therefore are described in T.H. James, *The Theory of The Photographic Process,* Third Edition, page 39, The Macmillan Company (1966).

The silver halide grains used in the present invention may have a composition or structure inside the grain which is different from that on the surface layer thereof. Also, the silver halide grains may be of the type where latent images are formed mainly on the surface thereof or of the type where latent images are formed mainly in the interior thereof. The latter type of grains are particularly useful for a direct positive emulsion.

During the formation or physical ripening of the silver halide grains, a cadmium salt, a zinc salt, a thallium salt, a lead salt, an iridium salt or a complex salt thereof, a rhodium salt or a complex salt thereof, an iron salt or a complex salt thereof, etc., may coexist in the system.

The silver halide emulsions are usually chemically sensitized. Conventional methods for chemical sensitization can be used. Details of these methods are described in JP-A-62-215272, at page 12, from left lower column, line 18 to right lower column, line 16.

Furthermore, the silver halide emulsions will usually spectrally sensitized. For spectral sensitization, methine dyes will ordinarily employed. Details of this are described in JP-A-62-215272, from page 22, right upper column, line 3 from the bottom to page 38 and Attachment B to Amendment thereof filed on Mar. 16, 1987.

The silver halide emulsions used in the present invention can contain various types of compounds for preventing the occurrence of fog or for stabilizing photographic performance during the production, storage and/or photographic processing of the color photographic material. Examples of such compounds include many compounds known as antifoggants or stabilizers such as azoles (e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles; particularly, 1-phenyl-5-mercaptotetrazole) mercaptopyrimidines, or mercaptotriazines; thioketo compounds such as oxazolinethione; azaindenes, (e.g., triazaindenes, tetraazaindenes particularly, 4-hydroxy-substituted 1,3,3a,7-tetraazaindene), or pentaazaindenes; benzenethiosulfonic acid; benzenesulfinic acid; or benzenesulfonic acid amide.

The color photographic light-sensitive material according to the present invention may contain a hydroquinone derivative, an aminophenol derivative, an amine, a gallic acid derivative, a catechol derivative, an ascorbic acid derivative, a non-color-forming coupler, or a sulfonamidophenol derivative, as a color fog preventing agent or a color mixing prevention agent.

In the color photographic light-sensitive material according to the present invention, various color fading prevention agents can be employed. Examples include organic color fading prevention agents for cyan, magenta and/or yellow images such as hindered phenols (e.g., hydroquinones, 6-hydroxychromans, 5-hydroxycoumarans, spirochromans, p-alkoxyphenols, or bisphenols), gallic acid derivatives, methylenedioxybenzenes, aminophenols, hindered amines, or ether or ester derivatives thereof derived from each of these compounds by sililation or alkylation of the phenolic hydroxy group thereof. Furthermore, metal complexes represented by (bissalicylaldoxymate) nickel complexes and (bis-N,N-dialkyldithiocarbamate) nickel complexes may be employed.

Specific examples of the organic color fading prevention agents are described in the following patents or patent applications. Hydroquinones: U.S. Pat. Nos. 2,360,290, 2,418,613, 2,700,453, 2,701,197, 2,728,659, 2,732,300, 2,735,765, 3,982,944 and 4,430,425, British Patent No. 1,363,921, U.S. Pat. Nos. 2,710,801 and 2,816,028; 6-hydroxychromanes, 5-hydroxycoumarans and spirochromanes: U.S. Pat. Nos. 3,432,300, 3,573,050, 3,574,627, 3,698,909 and 3,764,337, and JP-A-52-152225; spiroindanes: U.S. Pat. No. 4,360,589; p-alkoxyphenols: U.S. Pat. No. 2,735,765, British Patent No. 2,066,975, JP-A-59-10539, and JP-B-57-19764; hindered phenols: U.S. Pat. No. 3,700,455, JP-A-52 72225, U.S. Pat. No. 4,228,235, and JP-B-52-6623; gallic acid derivatives, methylenedioxybenzenes and aminophenols: U.S. Pat. Nos. 3,457,079 and 4,332,886, and JP-B-56-21144; hindered amines: U.S. Pat. Nos. 3,336,135 and 4,268,593, British Patent Nos. 1,326,889, 1,354,313 and 1,410,846, JP-B 51-1420, JP-A-58-114036, JP-A-59-53846, and JP-A-59-78344; ether or ester derivatives of phenolic hydroxy groups: U.S. Pat. Nos. 4,155,765, 4,174,220, 4,254,216 and 4,264,720, JP-A-54-145530, JP-A-55-6321, JP-A-58-105147, JP-A-59-10539, JP-B-57-37856, U.S. Pat. No. 4,279,990, and JP-B-53-3263.

Among the above described color fading prevention agents, spiroindanes and hindered amines are particularly preferred.

Specific examples of the suitable metal complexes are described in U.S. Pat. Nos. 4,050,938 and 4,241,155, and BP-A-2,027,731.

The color fading prevention agent may be co emulsified with the corresponding coupler in an amount of from 5 to 100% by weight of the coupler and incorporated into the light-sensitive layer to achieve its effect.

In order to prevent degradation of the cyan dye image due to heat, particularly due to light, it is further effective to introduce an ultraviolet light absorbing agent to a cyan color forming layer and/or both layers adjacent to the cyan color forming layer.

Suitable examples of the ultraviolet light absorbing agents described above include aryl group-substituted benzotriazole compounds (e.g., those as described in U.S. Pat. No. 3,533,794), 4-thiazolidone compounds (e.g., those described in U.S. Pat. Nos. 3,314,794 and 3,352,681), benzophenone compounds (e.g., those described in JP-A-46-2784), cinnamic acid ester compounds (e.g., those described in U.S. Pat. Nos. 3,705,805 and 3,707,375), butadiene compounds (e.g., those described in U.S. Pat. No. 4,045,229), and benzooccidol compounds (e.g., those described in U.S. Pat. No. 3,700,455). Furthermore, ultraviolet light absorptive couplers (e.g., α-naphtholic cyan dye forming couplers) or ultraviolet light absorptive polymers may be used as ultraviolet light absorbing agents. These ultraviolet light absorbing agents may be mordanted in a specific layer.

The color photographic light-sensitive material according to the present invention may contain water-soluble dyes as filter dyes or for irradiation prevention or other various purposes in the hydrophilic colloid layers. Examples of such water-soluble dyes include oxonol dyes, hemioxonol dyes, styryl dyes, merocyanine dyes, cyanine dyes, and azo dyes. Of these dyes, oxonol dyes, hemioxonol dyes, and merocyanine dyes are preferred.

Useful oxonol dyes are described in detail in JP-A-62-215272, from page 158, right upper column to page 163.

As the binder or protective colloids which can be used for the emulsion layers of the color photographic light-sensitive material according to the present invention, gelatin is advantageously used, but other hydrophilic colloids can be used together with gelatin or alone.

As the gelatin, lime-treated gelatin or acid-treated gelatin can be used in the present invention. Details of the production of gelatin are described in Arther Weiss, *The Macromolecular Chemistry of Gelatin,* published by Academic Press, 1964.

Known photographic additives can be used in the present invention. These are described in the following *Research Disclosure* documents concerned items thereof are summarized in the table below.

| Type of Additive | RD 17643 | RD 18716 |
|---|---|---|
| 1. Chemical Sensitizers | Page 23 | Page 648, right column |
| 2. Sensitivity Increasing Agents | | Page 648, right column |
| 3. Spectral Sensitizers and Super Sensitizers | Pages 23 to 24 | Page 648, right column to page 649, right column |
| 4. Whitening Agents | Page 24 | |
| 5. Antifoggants and Stabilizers | Pages 24 to 25 | Page 649, right column |
| 6. Light-Absorbers, Filter Dyes and Ultraviolet Ray Absorbers | Pages 25 to 26 | Page 649, right column to page 650, left column |
| 7. Antistaining Agents | Page 25, right column | Page 650, left column to right column |
| 8. Dye Image Stabilizers | Page 25 | |
| 9. Hardeners | Page 26 | Page 651, left column |
| 10. Binders | Page 26 | Page 651, left column |
| 11. Plasticizers and Lubricants | Page 27 | Page 650, right column |
| 12. Coating Aids and Surfactants | Pages 26 to 27 | Page 650, right column |
| 13. Antistatic Agents | Page 27 | Page 650, right column |

As the support used in the present invention, there are those conventionally employed in photographic light-sensitive materials such as cellulose nitrate films, cellulose acetate films, cellulose acetate butyrate films, cellulose acetate propionate films, polystyrene films, polyethylene terephthalate films, polycarbonate films, laminates of these films, thin glass films, or papers. Paper coated with baryta or an α- olefin polymer, in particular, a polymer of an α-olefin having from 2 to 10 carbon atoms such as polyethylene, polypropylene, or ethylenebutene copolymer, vinyl chloride resin containing a reflective material such as titanium dioxide, and a support such as a plastic film having a roughened surface for improving the adhesion with other polymers such as that described in JP-B-47-19068 give good results. Also, a resin hardenable by the irradiation of ultraviolet rays can be used.

According to a purpose of the color photographic light-sensitive material, a transparent support or an opaque support may be used. Also, a colored transparent support containing dyes or pigments can also be used.

As opaque supports used in the present invention, there are papers which are opaque by themselves and transparent films which were opacified by the incorporation of dyes or pigments such as titanium oxide. Also, a plastic film surface-treated by the method as described in JP-B-47-19068 can be used.

A subbing layer will usually be provided on a support. Furthermore, for improving adhesive properties, a pretreatment such as corona discharging treatment, ultraviolet irradiation treatment, or flame treatment, may be applied to the surface of the support.

The color photographic light-sensitive materials according to the present invention which are utilized to prepare color photographs are suitable for use as conventional color photographic materials (e.g., color negative films, color paper, color reversal paper, and color reversal films, particularly color photographic light-sensitive materials for printing).

For development processing of the color photographic light-sensitive materials according to the present invention, a black-and-white developing solution and/or a color developing solution may be employed.

A color developing solution which can be used is an alkaline aqueous solution containing preferably an aromatic primary amine type color developing agent as a main component. As the color developing agent, while an aminophenol type compound is useful, a p-phenylene diamine type compound is preferably employed. Typical examples of the p-phenylenediamine type compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamideethylaniline, 3-methyl-4-amino-N-ethyl-N-β-methoxyethylaniline, or sulfate, hydrocholoride, or p-toluenesulfonate thereof.

Two or more types of color developing agents may be employed in a combination thereof.

The color developing solution will ordinarily contain pH buffering agents such as carbonates, borates or phosphates of alkali metals; and development inhibitors or anti-fogging agents such as bromides, iodides, benzimidazoles, benzothiazoles, or mercapto compounds. If necessary, the color developing solution may contain various preservatives such as hydroxylamine, diethylhydroxylamine, sulfites, hydrazines, phenylsemi carbazides, triethanolamine, catechol sulfonic acids, or triethylenediamine(1,4-diazabicyclo[2,2,2]octane); organic solvents such as ethylene glycol, or diethylene glycol; development accelerators such as benzyl alcohol, polyethylene glycol, quaternary ammonium salts, or amines; dye forming couplers; competing couplers; fogging agents such as sodium borohydride; auxiliary developing agents such as 1-phenyl-3-pyrazolidone; viscosity imparting agents; and various chelating agents represented by aminopolycarboxylic acids, aminopolyphosphonic acids, alkylphosphonic acids, phosphonocarboxylic acids. Representative examples of chelating agents include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid), and salts thereof.

In case of conducting reversal processing, color development is usually conducted after black and-white development. In a black-and-white developing solution, known black-and-white developing agents, for example, dihydroxybenzenes such as hydroquinone, 3-pyrazolidones such as 1-phenyl 3-pyrazolidone, or aminophenols such as N-methyl-p-aminophenol, may be employed individually or in a combination.

The pH of the color developing solution or the black-and-white developing solution is usually ranges from 9 to 12. The amount of replenishment for the developing solution can be varied depending to color photographic light-sensitive materials to be processed, but is generally not more than 3 liters per square meter of the photographic light-sensitive material. The amount of replenishment can be reduced to not more than 500 ml by decreasing the bromide ion concentration in the replenisher. In the case of reducing the amount of replenishment, it is preferred to prevent evaporation and aerial oxidation of the processing solution by means of reducing an area of a processing tank which is contact with the air. Furthermore, the amount of replenishment can be reduced using a means which restrains accumulation of bromide ion in the developing solution.

After color development, the photographic emulsion layers will usually be subjected to bleach processing. The bleach processing can be performed simultaneously with fix processing (bleach-fix processing), or it can be performed independently from fix processing. For the purpose of rapid processing, a processing method wherein bleach-fix processing is conducted after bleach processing may be employed. Moreover, it may be appropriately practiced depending on the purpose to process using a continuous two tank bleach-fixing bath, to carry out fix processing before bleach-fix processing, or to conduct bleach processing after bleach-fix processing.

Examples of bleaching agents which can be employed in bleach processing or bleach-fix processing include compounds of a multivalent metal such as iron(III), cobalt(III), chromium(VI), or copper(II); peracids; quinones; or nitro compounds. Representative examples of the bleaching agents include ferricyanides; dichloromates; organic complex salts of iron(III) or cobalt(III), for example, complex salts of aminopolycarboxylic acids (such as ethylenediaminetetraacetic acid, diethylenetriaminepentaacetic acid, cyclohexanediaminetetraacetic acid, methyliminodiacetic acid, 1,3-diaminopropanetetraacetic acid, or glycol ether diaminetetraacetic acid), or complex salts of organic acids (such as citric acid, tartaric acid, or malic acid); persulfates; bromates; permanganates; or nitrobenzenes. Of these compounds, iron(III) complex salts of aminopolycarboxylic acids represented by iron(III) complex salt of ethylenediaminetetraacetic acid and persulfates are preferred in view of rapid processing and less environmental pollution. Furthermore, iron(III) complex salts of aminopolycarboxylic acids are particularly useful in both bleaching solutions and bleach-fixing solutions.

The pH of the bleaching solution or bleach-fixing solution containing an iron(III) complex salt of aminopolycarboxylic acid will usually ranges from 5.5 to 8. For the purpose of rapid processing, it is possible to process at pH lower than the above described range.

In the bleaching solution, the bleach-fixing solution or a prebath thereof, a bleach accelerating agent can be used, if desired. Specific examples of suitable bleach accelerating agents include compounds having a mercapto group or a disulfide bond such as those described, in U.S. Pat. No. 3,893,858, West German Patent Nos. 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure*, No. 17129 (July 1978); thiazolidine derivatives such as those described in JP-A-50-140129; thiourea derivatives such as those described in JP-B-45-8506, JP-A-52 20832, JP-A-53-32735 and U.S. Pat. No. 3,706,561; iodides such as those described in West German Patent No. 1,127,715 and JP-A-58-16235; polyoxyethylene compounds such as those described in West German Patent Nos. 966,410 and 2,748,430; polyamine compounds such as those described in JP-B-45-8836; compounds such as those described in JP-A-49-42434, JP-A-49-59644, JP-A-53-94927, JP A-54-35727, JP-A-55 26506 and JP-A 58-163940; and bromide ions. Of these compounds, compounds having a mercapto group or a disulfide bond are preferred in view of their large bleach accelerating effects. Particularly, the compounds described in U.S. Pat. No. 3,893,858, West German Patent No. 1,290,812 and JP-A-53-95630 are preferred. The compounds described in U.S. Pat. No. 4,552,834 are also preferred. These bleach accelerating agents may be incorporated into the color photographic light-sensitive material. These bleach accelerating agents are particularly effectively employed when color photographic light-sensitive materials for photographing are subjected to bleach-fix processing.

Examples of fixing agents which can be employed in the fixing solution or bleach-fixing solution include thiosulfates, thiocyanate, thioether compounds, thioureas, or a large amount of iodide. Of these compounds, thiosulfates will generally be employed, particularly, ammonium thiosulfate. It is preferred to use sulfites, bisulfites or carbonylbisulfite adducts as preservatives in the bleach-fixing solution.

After a desilvering step, the silver halide color photographic material according to the present invention will generally be subjected to a water washing step and/or a stabilizing step.

The amount of water required for the water washing step may range widely depending on the characteristics of the photographic light-sensitive materials (due to elements used therein, for example, couplers), uses thereof, temperatures of washing water, the number of water washing tanks (stages), the replenishment system such as countercurrent or orderly current, or other various conditions. A relationship between the number of water washing tanks and the amount of water in a multi-stage countercurrent system can be determined based on the method as described in *Journal of the Society of Motion Picture and Television Engineers,* Vol. 64, pages 248 to 253 (May, 1955).

According to the multi-stage countercurrent system described in the above literature, the amount of water for washing can be significantly reduced. However, an increase in the staying time of water in a tank causes propagation of bacteria Also, some problems, for example, adhesion of floatage formed on the photographic materials, may occur. In the method of processing the silver halide color photographic material according to the present invention, the method for reducing amounts of calcium ions and magnesium ions described in JP-A-62-288838 can be particularly effectively employed in order to solve such problems. Further, sterilizers such as isothiazolone compounds (see JP-A-57-8542), cyabendazoles, chlorine type sterilizers (such as sodium chloroisocyanurate etc.), benzotriazoles, the sterilizers described in Hiroshi Horiguchi, *Bokin-Bobai No Kagaku (Sankyo Shuppan,* 1986), *Biseibutsu No Mekkin-, Sakkin-, Bobai-Gijutsu,* edited by Eiseigijutsu Kai (1982), and *Bokin-Bobaizai Jiten,* edited by Nippon Bokin-Bobai Gakkai (1986), can be employed.

The pH of the washing water used in the processing of the photographic light-sensitive materials according to the present invention will usually range from 4 to 9, preferably from 5 to 8. The temperature of washing water and time for a water washing step can be variously set depending on characteristics or uses of the photographic light-sensitive materials. However, it may be appropriate to select a range of from 15° C. to 45° C. and a period from 20 sec. to 10 min. and preferably a range of from 25° C. to 40° C. and a period from 30 sec. to 5 min.

The photographic light-sensitive material of the present invention can also be directly processed with a stabilizing solution in place of the above described water washing step. In such a stabilizing process, any of the known methods may be used such as those described in JP-A-57-8543, JP-A-58-14834 and JP-A-60-220345.

It is also possible to conduct the stabilizing process after water-washing. One example thereof is a stabilizing bath containing formalin and a surface active agent, which is employed as a final bath in the processing of color photographic light-sensitive materials for photographing. To such a stabilizing bath, various chelating agents and antimolds may also be added.

Overflow solutions resulting from replenishment for the above-described washing water and/or stabilizing solution may be reused in other steps such as desilvering.

For the purpose of simplification and acceleration of processing, a color developing agent may be incorporated into the silver halide color photographic material according to the present invention. In order to incorporate the color developing agent, it is preferred to employ various precursors of color developing agents. Suitable examples of the precursors of developing agents include indoaniline type compounds such as those described in U.S. Pat. Nos. 3,342,597, Schiff's base-type compounds such as those described in U.S. Pat. No. 3,342,599 and *Research Disclosure,* No. 14850 (1976) and *ibid.,* No. 15159 (1976), aldol compounds such as those described in *Research Disclosure,* No. 13924 (1975), metal salt complexes such as those described in U.S. Pat. No. 3,719,492, and urethane-type compounds as described in JP-A-53-135628.

The silver halide color photographic material according to the present invention may contain, if desired, various 1-phenyl 3-pyrazolidones for the purpose of accelerating color development. Typical examples of such compounds include those described in JP-A-56-64339, JP-A-57-144547, and JP-A-58-115438.

In the present invention, various types of processing solutions can be employed in a temperature range from 10° C. to 50° C. Although a standard temperature is from 33° C. to 38° C., it is possible to carry out processing at higher temperatures in order to accelerate the processing whereby the processing time is shortened, or at lower temperatures in order to achieve improvement in image quality and to maintain stability of the processing solutions.

For the purpose of saving the amount of silver employed in the color photographic light-sensitive material, photographic processing may be conducted utilizing color intensification using cobalt or hydrogen peroxide as described in West German Patent No. 2,226,770 or U.S. Pat. No. 3,674,499.

In the interest of brevity and conciseness, the contents of the aforementioned numerous patents and articles are hereby incorporated by reference.

The present invention will be explained in greater detail with reference to the following examples, but the present invention should not be construed as being limited thereto.

EXAMPLE 1

10 g of Cyan coupler (C-1) having the structure illustrated below was dissolved in 5.0 ml of tricresyl phosphate and 20 ml of ethyl acetate. The resulting solution was added to 100 ml of an aqueous solution containing 10.0 g of gelatin and 0.8 g of sodium dodecylbenzenesulfonate, and the mixture was then finely emulsified and dispersed by a homogenizer.

The whole amount of the emulsified dispersion thus-prepared was mixed with 210 g of a silver iodobromide emulsion (having an iodide content of 5 mol% and containing 75.0 g of silver and 100 g of gelatin per kg of the emulsion), and the mixture was coated on a triacetate film support. The coating amount of coupler was adjusted to $1.50\times10^{-3}$ mol/m$^2$. On the light-sensitive layer thus-formed, a gelatin protective layer was coated at a gelatin coating amount of 1.00 g/m$^2$ to prepare a sample. To each of the layers was added 1-oxy-3,5-dichloro-s-triazine sodium salt was added as a hardener in a ratio of 0.025 by weight based on gelatin. The sample thus prepared was designated Sample 01.

Cyan Coupler (C-1)

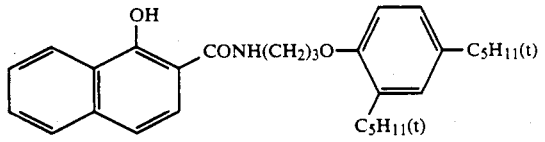

Sample 02 was prepared in the same manner as described for Sample 01 above except for mixing an aqueous Polymer latex (P-7) according to the present invention in a ratio of 0.5 by weight (as polymer component) based on Cyan coupler (C-1) with the coupler emulsion and the silver halide emulsion.

Samples 03 to 10 were prepared using the equal weight (as polymer component) of the polymer latexes according to the present invention and comparative polymers (as polymer component) as described in Table 1 below in place of Polymer latex (P-7) used in Sample 02, respectively.

Samples 01 to 10 thus-prepared were exposed to light wedgewise and then subjected to development processing according to the processing method described below.

| Processing Method | | |
|---|---|---|
| Processing Step | Processing Time | Processing Temperature (°C.) |
| Color Development | 3 min. 15 sec. | 38 |
| Bleaching | 6 min. 30 sec. | 38 |
| Washing with Water | 2 min. 10 sec. | 24 |
| Fixing | 4 min. 20 sec. | 38 |
| Washing with Water (1) | 1 min. 05 sec. | 24 |
| Washing with Water (2) | 1 min. 00 sec. | 24 |
| Stabilizing | 1 min. 05 sec. | 38 |
| Drying | 4 min. 20 sec. | 55 |

The composition of each processing solution used is illustrated below.

| | |
|---|---|
| Color Developing Solution: | |
| Diethylenetriaminepentaacetic acid | 1.0 g |
| 1-Hydroxyethylidene-1,1-diphosphonic acid | 3.0 g |
| Sodium sulfite | 4.0 g |
| Potassium carbonate | 30.0 g |
| Potassium bromide | 1.4 g |
| Potassium iodide | 1.5 mg |
| Hydroxylamine sulfate | 2.4 g |
| 4-(N-Ethyl-N-β-hydroxyethylamino)-2-methylaniline sulfate | 4.5 g |
| Water to make | 1.0 l |
| pH | 10.05 |
| Bleaching Solution: | |
| Sodium iron(III) ethylenediaminetetraacetate trihydrate | 100.0 g |
| Disodium ethylenediaminetetraacetate | 10.0 g |
| Ammonium bromide | 140.0 g |
| Ammonium nitrate | 30.0 g |
| Aqueous ammonia (27%) | 6.5 ml |
| Water to make | 1.0 l |
| pH | 6.0 |
| Fixing Solution: | |
| Disodium ethylenediaminetetraacetate | 0.5 g |
| Sodium sulfite | 7.0 g |
| Sodium bisulfite | 5.0 g |
| Aqueous solution of ammonium thiosulfate (70%) | 170.0 ml |
| Water to make | 1.0 l |
| pH | 6.7 |
| Stabilizing Solution: | |
| Formalin (37%) | 2.0 ml |
| Polyoxyethylene-p-monononylphenylether (average degree of polymerization: 10) | 0.3 g |
| Disodium ethylenediaminetetraacetate | 0.05 g |
| Water to make | 1.0 l |
| pH | 5.0 to 8.0 |

The samples thus-processed were measured for their densities to obtain their characteristic curves. Then, the samples were treated with a processing solution described below at 38° C. for 5 minutes under stirring with nitrogen gas, washed with running water for 3 minutes, and dried with a jet stream of nitrogen gas at room temperature. Their densities were again measured using the same densitometer.

| Processing Solution: | |
|---|---|
| Distilled water | 800 ml |
| Ethylenediaminetetraacetic acid | 32.1 g |
| Concentrated aqueous ammonia (27%) | 30.0 ml |
| Ferrous sulfate 7 hydrate | 27.8 g |
| Distilled water to make | 1,000 ml |

pH was adjusted to 5.0 with aqueous ammonia or acetic acid

From their characteristic curves, the decrease in cyan density due to ferrous ions was determined in the same sample. Specifically, using the same sample, cyan density (D) on a characteristic curve showing the result of the treatment with ferrous ions at a point of exposure amount necessary to provide cyan density of 1.0 on a characteristic curve showing the results of the first processing was obtained, and thereby, the decrease ratio of cyan density ($D_R$) was determined according to the following equation:

$$D_R = \frac{1.0 - D}{1.0} \times 100$$

The results obtained are shown in Table 1 below.

TABLE 1

| Sample | Polymer | Decrease Ratio of Cyan Density | Remark |
|---|---|---|---|
| 01 | — | 87 | Comparison |
| 02 | P-1 | 16 | Present Invention |
| 03 | P-8 | 24 | " |
| 04 | P-9 | 18 | " |
| 05 | Comparative polymer 1 | 90 | Comparison |
| 06 | Comparative polymer 2 | 81 | " |
| 07 | P-18 | 20 | Present Invention |
| 08 | P-26 | 14 | " |
| 09 | Comparative polymer 3 | 92 | Comparison |
| 10 | Comparative polymer 4 | 28 | " |

Comparative polymer

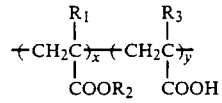

x/y (by weight)

TABLE 2

| Comparative Polymer | $R_1$ | $R_2$ | $R_3$ | x/y | Remark |
|---|---|---|---|---|---|
| 1 | $-CH_3$ | $-CH_2CH_2CH_2CH_3$ | — | 100/0 | |
| 2 | $-CH_3$ | $-CH_2CH_2OC_4H_9$ | — | 100/0 | |
| 3 | $-CH_3$ | $-CH_2CH_2CH_2CH_3$ | $-CH_3$ | 90/10 | |
| 4 | $-H$ | $-CH_2CH_2OCH_3$ | $-H$ | 90/10 | described in EP0294104A1 |

From the results shown in Table 1 it is apparent that the polymer latexes according to present invention exhibit the remarkable effect on preventing a decrease in cyan image density due to ferrous ions. It is also recognized that the polymer according to the present invention provides the extraordinarily good effect by means of the presence of a methoxy group at the end of the carboxylic acid ester portion in the polymer relative to the comparative polymers. Furthermore, it is clear that the polymer according to the present invention is superior to the latex polymer described in EP0294104 A1 as another comparative polymer.

The samples subjected to the first development processing were exposed to light at room temperature for 9 days on the emulsion side in a fluorescent lamp fading tester (10,000 lux) to determine the preservability of color image.

The results obtained are shown in Table 3 below.

TABLE 3

| Sample | $\Delta D_5$ | Remark |
|---|---|---|
| 01 | 0.07 | Comparison |
| 02 | 0.02 | Present Invention |
| 03 | 0.02 | " |
| 04 | 0.03 | " |
| 05 | 0.07 | Comparison |
| 06 | 0.08 | " |
| 07 | 0.03 | Present Invention |
| 08 | 0.03 | " |
| 09 | 0.09 | Comparison |
| 10 | 0.07 | " |

$\Delta D_5$: Value obtained by subtracting a yellow density at the unexposed area before the light exposure from a yellow density at the unexposed area after the light exposure for 9 days with a fluorescent lamp (10,000 lux).

From the above described results, it can be seen that the samples using the polymer latex according to the present invention can prevent a decrease in cyan density due to ferrous ions and the occurrence of light stain due to light exposure for a long period of time.

EXAMPLE 2

On a paper support, both surfaces of which were laminated with polyethylene, were coated the layers shown below in order to prepare a multilayer color printing paper which was designated Sample 21. The coating solutions were prepared in the following manner.

Preparation of Coatinq Solution for First Layer 19.1 g of Yellow coupler (ExY), 4.4 g of color image stabilizer (Cpd-1) and 0.7 g of color image stabilizer (Cpd-7) were dissolved in a mixture of 27.2 ml of ethyl acetate and 8.2 g of Solvent (Solv-3) and the resulting solution was emulsified and dispersed in 18.5 ml of a 10% aqueous solution of gelatin containing 8 ml of a 10% aqueous solution of sodium dodecylbenzenesulfonate. Separately, to a silver chlorobromide emulsion (cubic grains, mixture of two emulsions having average grain size of 0.88 mμ and 0.70 mμ in 3:7 by molar ratio of silver, coefficient of variation of grain size: 0.08 and 0.10 respectively, 0.2 mol% silver bromide based on the whole of grains being localized at the surface of grains respectively) were added the two blue-sensitive sensitizing dyes shown below in an amount each of $2.0\times10^{-4}$ mol per mol of silver in the case of the larger grain size emulsion and in an amount each of $2.5\times10^{-4}$ mol per mol of silver in the case of the smaller grain size emulsion. The emulsion was then subjected to sulfur sensitization. The above described emulsified dispersion was mixed with the silver chlorobromide emulsion, with the concentration of the resulting mixture being controlled to form the composition shown below, whereby the coating solution for the first layer was prepared.

Coating solutions for the second layer to the seventh layer were prepared in a similar manner as described for the coating solution for the first layer.

1-Oxy-3,5-dichloro-s-triazine sodium salt was used as a gelatin hardener in each layer.

The following spectral sensitizing dyes were employed in the emulsion layers, respectively.

Blue-Sensitive Emulsion Layer

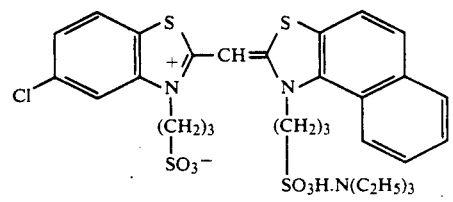

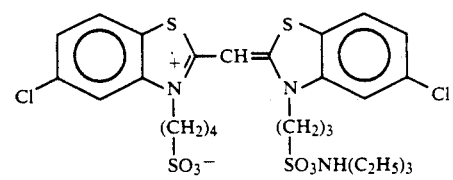

(Amount added: each $2.0\times10^{31\ 4}$ mol per mol of silver halide in the larger grain size emulsion and each $2.5\times10^{-4}$ mol per mol of silver halide in the smaller grain size emulsion)

Green-Sensitive Emulsion Layer

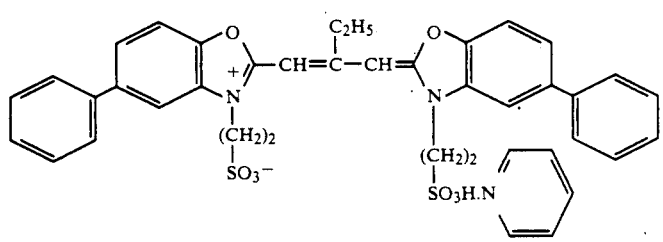

(Amount added: $4.0\times10^{-4}$ mol per mol of silver halide in the larger grain size emulsion and $5.6\times10^{-4}$ mol per mol of silver halide in the smaller grain size emulsion) and

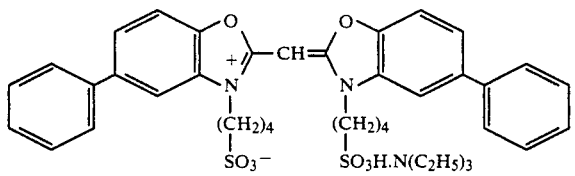

(Amount added: $7.0\times10^{-5}$ mol per mol of silver halide in the larger grain size emulsion and $1.0\times10^{-5}$ mol per mol of silver halide in the smaller grain size emulsion)

Red-Sensitive Emulsion Layer

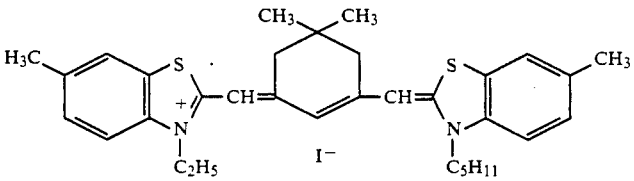

(Amount added: $0.9\times10^{-4}$ mol per mol of silver halide in the larger grain size emulsion and $1.1\times10^{-5}$ mol per mol of silver halide in the smaller grain size emulsion)

To the red-sensitive emulsion layer, was added the compound shown below in an amount of $2.6\times10^{-3}$ mol per mol of silver halide.

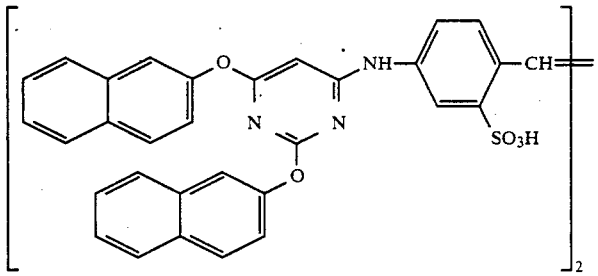

To the blue-sensitive emulsion layer, green-sensitive emulsion layer and red-sensitive emulsion layer, was added 1-(5-methylureidophenyl)-5-mercaptotetrazole in amounts of $8.5\times10^{-5}$ mol, $7.7\times10^{-4}$ mol and $2.5\times10^{-4}$ mol per of silver halide, respectively.

Moreover, in order to prevent irradiation, the following dyes were added to the emulsion layers.

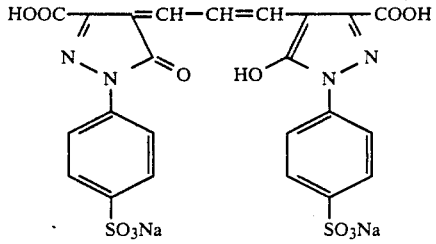

and

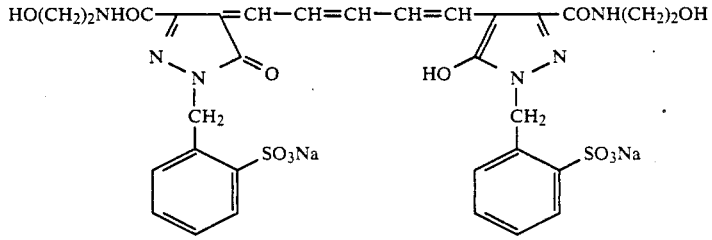

Layer Construction

The composition of each layer is shown below. The numerical values denote the coating amounts of components in the unit of g/m$^2$. The coating amount of silver halide emulsion is indicated in terms of silver coating amount.

| | | |
|---|---|---|
| Support | Polyethylene laminated paper (the polyethylene coating containing a white pigment ($TiO_2$) and a bluish dye (ultramarine) on the first layer side) | |
| First Layer (Blue-sensitive layer) | Silver chlorobromide emulsion described above | 0.30 |
| | Gelatin | 1.86 |
| | Yellow coupler (ExY) | 0.82 |
| | Color image stabilizer (Cpd-1) | 0.19 |
| | Solvent (Solv-3) | 0.35 |
| | Color image stabilizer (Cpd-7) | 0.06 |
| Second Layer | Gelatin | 0.99 |

-continued

| | | |
|---|---|---|
| (Color mixing preventing layer) | Color mixing preventing agent (Cpd-5) | 0.08 |
| | Solvent (Solv-1) | 0.16 |
| | Solvent (Solv-4) | 0.08 |
| Third Layer (Green-Sensitive layer) | Silver chlorobromide emulsion (cubic grains, mixture of two emulsions having average grain size of 0.55 μm and 0.39 μm in 1:3 by molar ratio of silver, coefficient of variation of grain size: 0.10 and 0.08 respectively, 0.8 mol % silver bromide based on the whole of grains being localized at the surface of grains respectively) | 0.12 |
| | Gelatin | 1.24 |
| | Magenta Coupler (ExM) | 0.20 |
| | Color image stabilizer (Cpd-3) | 0.15 |
| | Color image stabilizer (Cpd-4) | 0.02 |
| | Color image stabilizer (Cpd-6) | 0.03 |
| | Solvent (Solv-2) | 0.40 |
| Fourth Layer (Ultraviolet light absorbing layer) | Gelatin | 1.58 |
| | Ultraviolet light absorbing agent (UV-1) | 0.47 |
| | Color mixing preventing agent (Cpd-5) | 0.05 |
| | Solvent (Solv-5) | 0.24 |
| Fifth Layer (Red-sensitive layer) | Silver chlorobromide emulsion (cubic grains, mixture of two emulsions having average grain size of 0.58 μm and 0.45 μm in 1:4 by molar ratio of silver, coefficient of variation of grain size: 0.09 and 0.11 respectively, 0.6 mol % silver bromide based on the whole of grains being localized at a part of the surface of grains) | 0.23 |
| | Gelatin | 1.34 |
| | Cyan Coupler (ExC) | 0.32 |
| | Solvent (Solv-6) | 0.15 |
| Sixth Layer (Ultraviolet light absorbing layer) | Gelatin | 0.53 |
| | Ultraviolet light absorbing agent (UV-1) | 0.16 |
| | Color mixing preventing agent (Cpd-5) | 0.02 |
| | Solvent (Solv-5) | 0.08 |
| Seventh Layer (Protective layer) | Gelatin | 1.33 |
| | Acryl-modified polyvinyl alcohol copolymer (Degree of modification: 17%) | 0.17 |
| | Liquid paraffin | 0.03 |

The compounds used in the above-described layers have the chemical structures shown below respectively.

Yellow coupler (ExY)

In a compound of

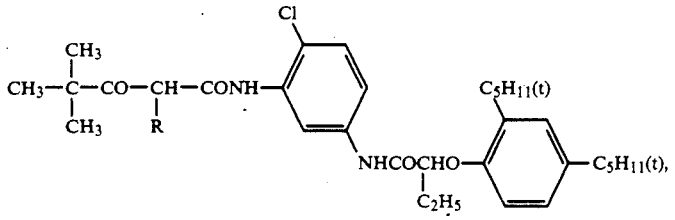

a mixture of a compound wherein R represents the following group

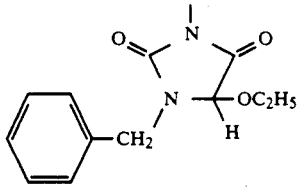

and a compound wherein R represents the following group

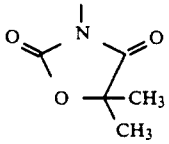

in a molar ratio of 1:1.

Magenta coupler (ExM)

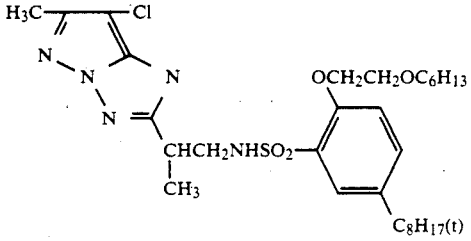

Cyan coupler (ExC)

In a compound of

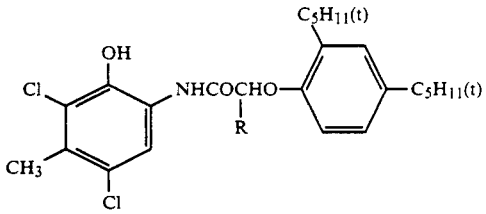

a mixture of a compound wherein R represents, $C_2H_5$, $C_4H_9$ and

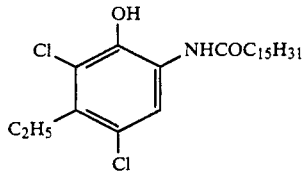
in a weight ratio of 2:4:4.
Color image stabilizer (Cpd-1)
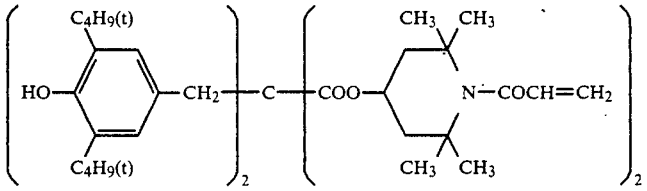
Color image stabilizer (Cpd-3)
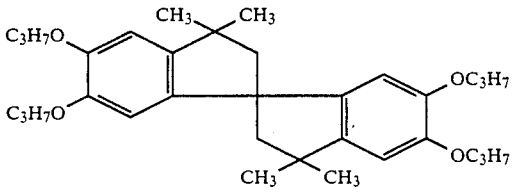
Color mixing preventing agent (Cpd-5)
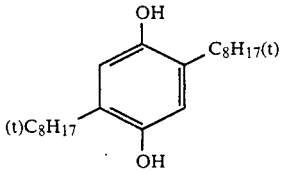
Color image stabilizer (Cpd-4)
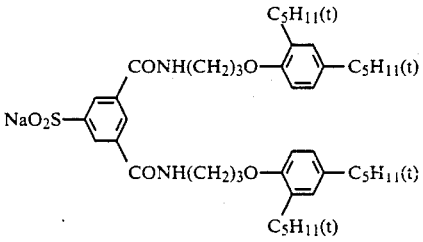
Color image stabilizer (Cpd-6)
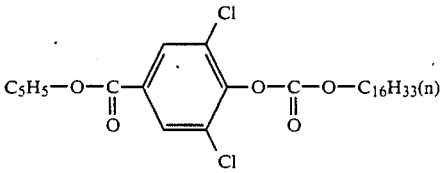
Color image stabilizer (Cpd-7)
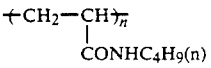
(average molecular weight: 60,000)
Ultraviolet light absorbing agent (UV-1)
A mixture of
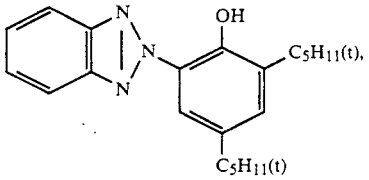
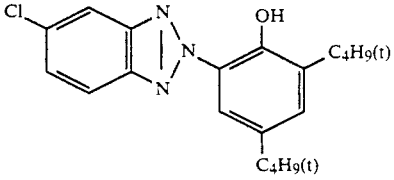
and
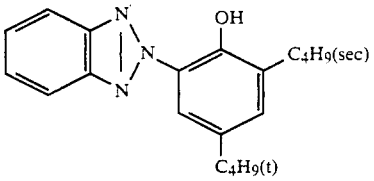
in a weight ratio of 4:2:4.
Solvent (Solv-1)
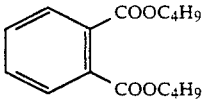
Solvent (Solv-2)
A mixture of
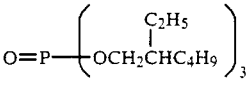
and -continued

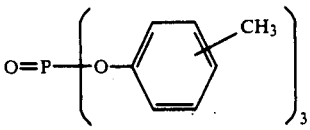

in a volume ratio of 2:1

Solvent (Solv-3)

$O{=}P{\leftarrow}O{-}C_9H_{19}(iso))_3$

Solvent (Solv-4)

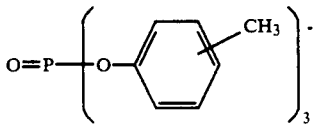

Solvent (Solv-5)

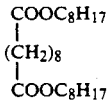

Solvent (Solv-6)

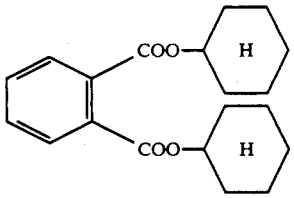

Sample 22 was prepared in the same manner as described for Sample 21 above except for mixing Polymer latex (P-7) according to the present invention in a ratio of 0.5 by weight (as polymer component) based on the cyan coupler with the coupler emulsion and the silver halide emulsion in the preparation of the fifth layer, i.e., the red-sensitive layer.

Furthermore, Samples 23 to 25 were prepared using the equal weight of (as polymer component) of Polymer latex (P-24) according to the present invention and comparative polymers 1 and 5 as described in Table 4 below in place of Polymer latex (P-7) used in Sample 22, respectively.

Samples 21 to 25 to light through a wedge equipped with a B-G-R three color separation filter for 0.1 second in an exposure amount of 250 CMC, and then subjected to development processing according to the processing steps described below using a paper processor.

| Processing Step | Temperature (°C.) | Time | Amount of* Replenishment (ml) | Tank Capacity (l) |
|---|---|---|---|---|
| Color Development | 35 | 45 sec. | 161 | 17 |
| Bleach-Fixing | 30–35 | 45 sec. | 55 | 17 |
| Rinse (1) | 30–35 | 20 sec. | — | 10 |
| Rinse (2) | 30–35 | 20 sec. | — | 10 |
| Rinse (3) | 30–35 | 20 sec. | 350 | 10 |
| Drying | 70–80 | 60 sec. | | |

*The amount of replenishment per $m^2$ of photographic light-sensitive material

The rinse steps were conducted using a three-tank countercurrent system from Rinse (3) to Rinse (1).

The composition of each processing solution used is illustrated below.

| | Tank Solution | Replenisher |
|---|---|---|
| Color Developing Solution: | | |
| Water | 800 ml | 800 ml |
| Ethylenediamine-N,N,N,N-tetramethylenephosphonic acid | 1.5 g | 2.0 g |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl)hydrazine | 5.5 g | 7.0 g |
| Fluorescent brightening agent (WHITEX 4B manufactured by Sumitomo Chemical Co., Ltd.) | 1.0 g | 2.0 g |
| Water to make | 1000 ml | 1000 ml |
| pH (at 25° C.) | 10.05 | 10.45 |
| Bleach-Fixing Solution: | | |
| Water | 400 ml | 400 ml |
| Ammonium thiosulfate (70%) | 110 ml | 220 ml |
| Ammonium sulfite monohydrate | 17.5 g | 35 g |
| Ammonium Iron (III) ethylenediaminetetraacetate | 55 g | 110 g |
| Ethylenediaminetetraacetic acid | 1.5 g | 3.0 g |
| Ammonium bromide | 25 g | 50 g |
| Nitric acid (60 wt %) | 24 g | 48 g |
| Water to make | 1000 ml | 1000 ml |
| pH (at 25° C.) | 5.20 | 4.80 |

Rinse Solution: (both tank solution and replenisher)

Ion-exchanged water (calcium and magnesium contents: not more than 3 ppm respectively)

The samples thus-processed were measured for their densities of color images formed to obtain their characteristic curves. Then, imagewise exposed samples were continuously processed until the amount of replenisher for the bleach-fixing solution reached twice the volume of the tank for bleach-fixing step. Thereafter, Samples 21 to 25 were exposed under the same condition as described above and processed. Densities of the samples thus-processed were measured in the same manner as above by the same densitometer used for the measurement of density before the continuous processing to obtain their characteristic curves.

From these characteristic curves obtained before and after the continuous processing, the difference ($\Delta_S$) of sensitivity (amount of exposure required for obtaining a density of the minimum density +0.5) of the cyan color image between before the continuous processing and after the continuous processing, was obtained as a photographic characteristic value. A density at a point which had an exposure amount of log E 0.5 larger than that of the above-described sensitivity point of cyan color image was determined, and the change in density of cyan color image between before the continuous processing and the equilibrium condition was evaluated according to the following equation:

$$D(\%) = \frac{\text{Before Continuous Processing} - \text{After continuous Processing}}{\text{Before Continuous Processing}} \times 100$$

The results obtained are shown in Table 4 below.

Samples 21 to 25 subjected to the first development processing were exposed to light at room temperature for 14 days on the emulsion side in a fluorescent lamp fading tester (10,000 lux) to determine the preservability of color image.

The results obtained are also shown in Table 4 below.

TABLE 4

| Sample | Polymer | Change in Photographic Performance $\Delta_S$ | D (%) | $\Delta D_S$ | Remark |
|---|---|---|---|---|---|
| 21 | — | 0.06 | 0.10 | 0.10 | Comparison |
| 22 | P-7 | 0.02 | 0.02 | 0.03 | Present Invention |
| 23 | P-24 | 0.03 | 0.04 | 0.04 | Present Invention |
| 24 | Comparative polymer 1 | 0.08 | 0.15 | 0.12 | Comparison |
| 25 | Comparative polymer 5 | 0.05 | 0.07 | 0.10 | Comparison |

Comparative polymer 5

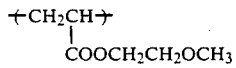

(Compound as described in EP0294104A1)

In Table 4 above, $\Delta D_S$ has the same meaning as defined in Example 1. The smaller $\Delta_S$ value is, the smaller the change in sensitivity is, and the smaller D is, the smaller is the decrease in cyan density.

From the results shown in Table 4 above, it is apparent that the samples using the polymer latex according to the present invention are effective on repression of the change in photographic performance due to the exhausted processing solution and on prevention from the occurrence of light stain due to light exposure for long periods of time.

EXAMPLE 3

On a cellulose triacetate film support provided with a subbing layer there was coated each layer having the composition set forth below to prepare a multilayer color photographic light-sensitive material which was designated as Sample 31.

With respect to the compositions of the layers, coating amounts of silver halide and colloidal silver are shown by g/m$^2$ units in terms of silver, the coating amounts of couplers, additives and gelatin are shown by g/m$^2$ units, and the coating amounts of sensitizing dyes are shown by mol number per mol of silver halide present in the same layer.

The symbols which denote additives used below have the meanings described below. When the additive has two or more functions, one of them is indicated as representative.

UV: Ultraviolet light absorbing agent
Solv: Organic solvent having a high boiling point
ExF: Dye
ExS: Sensitizing dye
ExC: Cyan coupler
ExM: Magenta coupler
ExY: Yellow coupler
Cpd Additive

| | |
|---|---|
| First Layer: Antihalation Layer | |
| Black colloidal silver | 0.15 |
| Gelatin | 2.9 |
| UV-1 | 0.03 |
| UV-2 | 0.06 |
| UV-3 | 0.07 |
| Solv-2 | 0.08 |
| ExF-1 | 0.01 |
| ExF-2 | 0.01 |
| Second Layer: Low-Speed Red-Sensitive Emulsion Layer | |
| Silver Iodobromide Emulsion (AgI: 4 mol %, uniform AgI type, diameter corresponding to sphere: 0.4 μm, coefficient of variation of diameter corresponding to sphere: 37%, tabular grain, diameter/thickness ratio: 3.0) | 0.4 (as silver) |
| Gelatin | 0.8 |
| ExS-1 | $2.3 \times 10^{-4}$ |
| ExS-2 | $1.4 \times 10^{-4}$ |
| ExS-5 | $2.3 \times 10^{-4}$ |
| ExS-7 | $8.0 \times 10^{-6}$ |
| ExC-1 | 0.17 |
| ExC-2 | 0.03 |
| ExC-3 | 0.13 |
| Third Layer: Medium-Speed Red-Sensitive Emulsion Layer | |
| Silver Iodobromide Emulsion (AgI: 6 mol %, internal high AgI type, with core/shell ratio of 2:1, diameter corresponding to sphere: 0.65 μm, coefficient of variation of diameter corresponding to sphere: 25%, tabular grain, diameter/thickness ratio: 2.0) | 0.65 (as silver) |
| Silver Iodobromide Emulsion (AgI: 4 mol %, uniform AgI type, diameter corresponding to sphere: 0.4 μm, coefficient of variation of diameter corresponding to sphere: 37%, tabular grain, diameter/thickness ratio: 3.0) | 0.1 (as silver) |
| Gelatin | 1.0 |
| ExS-1 | $2 \times 10^{-4}$ |
| ExS-2 | $1.2 \times 10^{-4}$ |
| ExS-5 | $2 \times 10^{-4}$ |
| ExS-7 | $7 \times 10^{-6}$ |
| ExC-1 | 0.31 |
| ExC-2 | 0.01 |
| ExC-3 | 0.06 |
| Fourth Layer: High-Speed Red-sensitive Emulsion Layer | |
| Silver Iodobromide Emulsion (AgI: 6 mol %, internal high AgI type, with core/shell ratio of 2:1, diameter corresponding to sphere: 0.7 μm, coefficient of variation of diameter corresponding to sphere: 25%, tabular grain, diameter/thickness ratio: 2.5) | 0.9 (as silver) |
| Gelatin | 0.8 |
| ExS-1 | $1.6 \times 10^{-4}$ |
| ExS-2 | $1.6 \times 10^{-4}$ |
| ExS-5 | $1.6 \times 10^{-4}$ |
| ExS-7 | $6 \times 10^{-4}$ |
| ExC-1 | 0.07 |
| ExC-4 | 0.05 |
| Solv-1 | 0.07 |
| Solv-2 | 0.20 |
| Cpd-7 | $4.6 \times 10^{-4}$ |
| Fifth Layer: Intermediate Layer | |
| Gelatin | 0.6 |
| UV-4 | 0.03 |
| UV-5 | 0.04 |
| Cpd-1 | 0.1 |
| Polyethyl acrylate latex | 0.08 |

-continued

| | |
|---|---|
| Solv-1 | 0.05 |
| Sixth Layer: Low-Speed Green-Sensitive Emulsion Layer | |
| Silver Iodobromide Emulsion (AgI: 4 mol %, uniform AgI type, diameter corresponding to sphere: 0.4 μm, coefficient of variation of diameter corresponding to sphere: 37%, tabular grain, diameter/thickness ratio: 2.0) | 0.18 (as silver) |
| Gelatin | 0.4 |
| ExS-3 | $2 \times 10^{-4}$ |
| ExS-4 | $7 \times 10^{-4}$ |
| ExS-5 | $1 \times 10^{-4}$ |
| ExM-5 | 0.11 |
| ExM-7 | 0.03 |
| ExY-8 | 0.01 |
| Solv-1 | 0.09 |
| Solv-4 | 0.01 |
| Seventh Layer: Medium Speed Green-Sensitive Emulsion Layer | |
| Silver Iodobromide Emulsion (AgI: 4 mol %, surface high AgI type, with core/shell ratio of 1:1, diameter corresponding to sphere: 0.5 μm, coefficient of variation of diameter corresponding to sphere: 20%, tabular grain, diameter/thickness ratio: 4.0) | 0.27 (as silver) |
| Gelatin | 0.6 |
| ExS-3 | $2 \times 10^{-4}$ |
| ExS-4 | $7 \times 10^{-4}$ |
| ExS-5 | $1 \times 10^{-4}$ |
| ExM-5 | 0.17 |
| ExM-7 | 0.04 |
| ExY-8 | 0.02 |
| Solv-1 | 0.14 |
| Solv-4 | 0.02 |
| Eighth Layer: High-Speed Green-Sensitive Emulsion Layer | |
| Silver Iodobromide Emulsion (AgI: 8.7 mol %, multi-layer structure grain having silver amount ratio of 3:4:2, AgI content: 24 mol, 0 mol, 3 mol from inside, diameter corresponding to sphere: 0.7 μm, coefficient of variation of diameter corresponding to sphere: 25%, tabulr grain, diameter/thickness ratio: 1.6) | 0.7 (as silver) |
| Gelatin | 0.8 |
| ExS-4 | $5.2 \times 10^{-4}$ |
| ExS-5 | $1 \times 10^{-4}$ |
| ExS-8 | $0.3 \times 10^{-4}$ |
| ExM-5 | 0.1 |
| ExM-6 | 0.03 |
| ExY-8 | 0.02 |
| ExC-1 | 0.02 |
| ExC-4 | 0.01 |
| Solv-1 | 0.25 |
| Solv-2 | 0.06 |
| Solv-4 | 0.01 |
| Cpd-7 | $1 \times 10^{-4}$ |
| Ninth Layer: Intermediate Layer | |
| Gelatin | 0.6 |
| Cpd-1 | 0.04 |
| Polyethyl acrylate latex | 0.12 |
| Solv-1 | 0.02 |
| Tenth Layer: Donor Layer of Interimage Effect to Red-Sensitive Layer | |
| Silver Iodobromide Emulsion (AgI: 6 mol %, internal high AgI type, with core/shell ratio of 2:1, diameter corresponding to sphere: 0.7 μm, coefficient of variation of diameter corresponding to sphere: 25%, tabular grain, diameter/thickness ratio: 2.0) | 0.68 (as silver) |
| Silver Iodobromide Emulsion (AgI: 4 mol %, uniform AgI type, diameter corresponding to sphere: 0.4 μm, coefficient of variation of diameter corresponding to sphere: 37%, tabular grain, diameter/thickness ratio: 3.0) | 0.19 (as silver) |

-continued

| | |
|---|---|
| Gelatin | 1.0 |
| ExS-3 | $6 \times 10^{-4}$ |
| ExM-10 | 0.19 |
| Solv-1 | 0.20 |
| Eleventh Layer: Yellow Filter Layer | |
| Yellow Colloidal Silver | 0.06 |
| Gelatin | 0.8 |
| Cpd-2 | 0.13 |
| Solv-1 | 0.13 |
| Cpd-1 | 0.07 |
| Cpd-6 | 0.002 |
| H-1 | 0.13 |
| Twelfth Layer: Low-Speed Blue-sensitive Emulsion Layer | |
| Silver Iodobromide Emulsion (AgI: 4.5 mol %, uniform AgI type, diameter corresponding to sphere: 0.7 μm, coefficient of variation of diameter corresponding to sphere: 15%, tabular grain, diameter/thickness ratio: 7.0) | 0.3 (as silver) |
| Silver Iodobromide Emulsion (AgI: 3 mol %, uniform AgI type, diameter corresponding to sphere: 0.3 μm, coefficient of variation of diameter corresponding to sphere: 30%, tabular grain, diameter/thickness ratio: 7.0) | 0.15 (as silver) |
| Gelatin | 1.8 |
| ExS-6 | $9 \times 10^{-4}$ |
| ExC-1 | 0.06 |
| ExC-4 | 0.03 |
| ExY-9 | 0.14 |
| ExY-11 | 0.89 |
| Solv-1 | 0.42 |
| Thirteenth Layer: Intermediate Layer | |
| Gelatin | 0.7 |
| ExY-12 | 0.20 |
| Solv-1 | 0.34 |
| Fourteenth Layer: High-Speed Blue-sensitive Emulsion Layer | |
| Silver Iodobromide Emulsion (AgI: 10 mol %, internal high AgI type, diameter corresponding to sphere: 1.0 μm, coefficient of variation of diameter corresponding to sphere: 25%, multiple twin tabular grain, diameter/thickness ratio: 2.0) | 0.5 (as silver) |
| Gelatin | 0.5 |
| ExS-6 | $1 \times 10^{-4}$ |
| ExY-9 | 0.01 |
| ExY-11 | 0.20 |
| ExC-1 | 0.02 |
| Solv-1 | 0.10 |
| Fifteenth Layer: First Protective Layer | |
| Fine Grain Silver Iodobromide Emulsion (AgI: 2 mol %, uniform AgI type, diameter corresponding to sphere: 0.07 μm) | 0.12 (as silver) |
| Gelatin | 0.9 |
| UV-4 | 0.11 |
| UV-5 | 0.16 |
| Solv-5 | 0.02 |
| H-1 | 0.13 |
| Cpd-5 | 0.10 |
| Polyethyl Acrylate Latex | 0.09 |
| Sixteenth Layer: Second Protective Layer | |
| Fine Grain Silver Iodobromide Emulsion (AgI: 2 mol %, uniform AgI type, diameter corresponding to sphere: 0.07 μm) | 0.36 (as silver) |
| Gelatin | 0.55 |
| Polymethyl Methacrylate Particle (diameter: 1.5 μm) | 0.2 |
| H-1 | 0.17 |

Each layer described above further contained a stabilizer for the emulsion (Cpd-3: 0.07 g/m$^2$) and a surface active agent (Cpd-4: 0.03 g/m$^2$) as a coating aid in addition to the above-described components.

The components used for the preparation of the light-sensitive material are illustrated below.
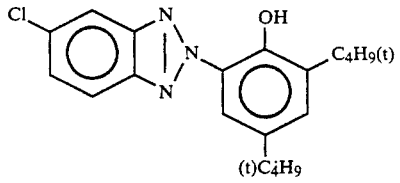
UV-1
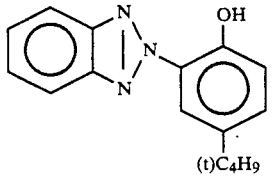
UV-2
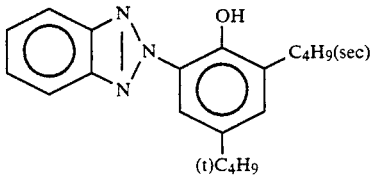
UV-3
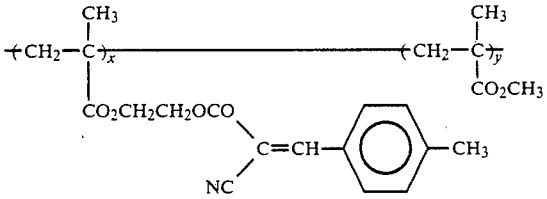
x:y = 70:30(wt %)
UV-4
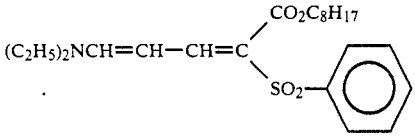
UV-5
Tricresyl phosphate — Solv-1
Dibutyl phthalate — Solv-2
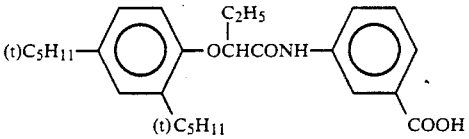
Solv-4
Trihexyl phosphate — Solv-5
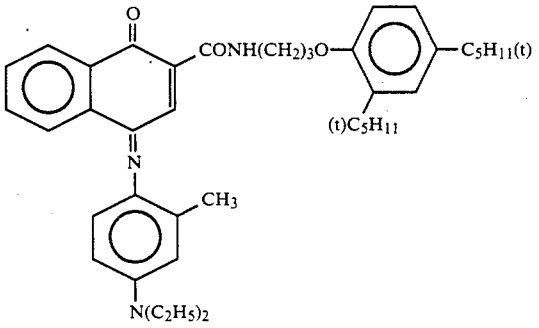
ExF-1

-continued
ExF-2
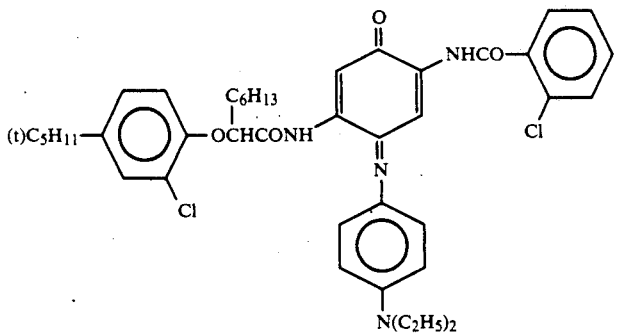
ExS-1
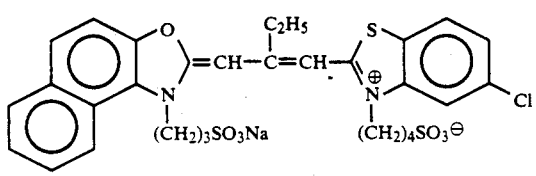
ExS-2
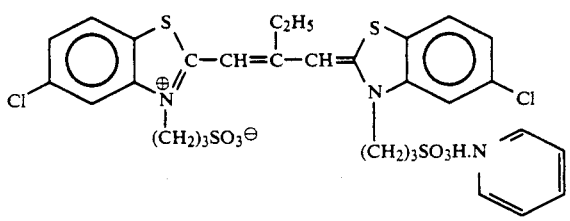
ExS-3
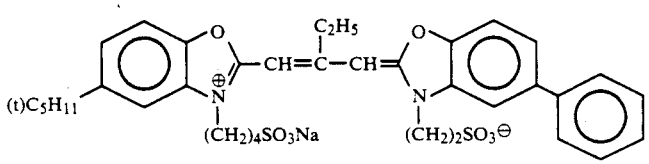
ExS-4
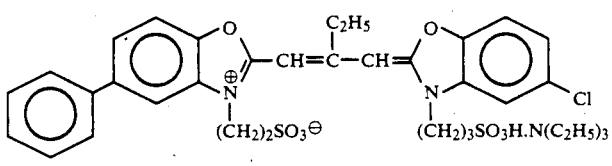
ExS-5
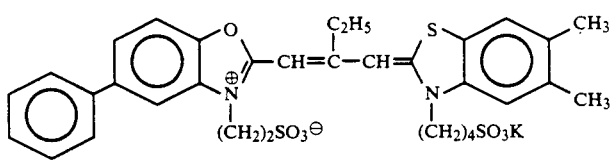
ExS-6
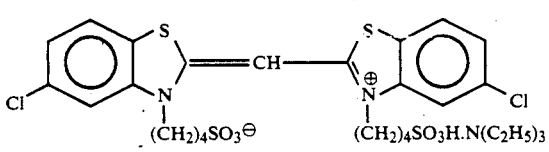
ExS-7
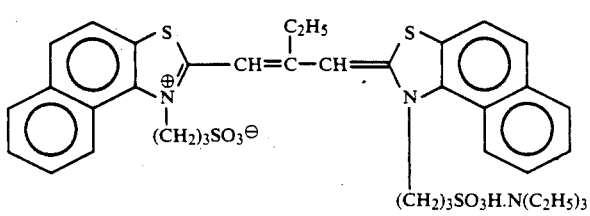

-continued
ExS-8
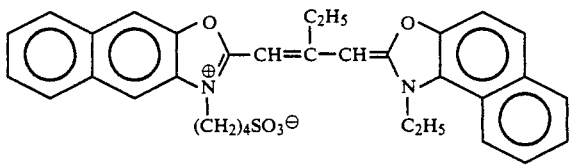
ExC-1
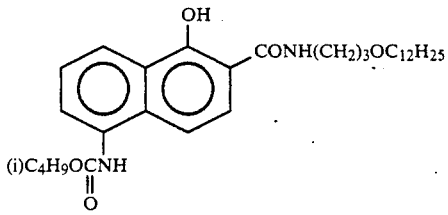
ExC-2
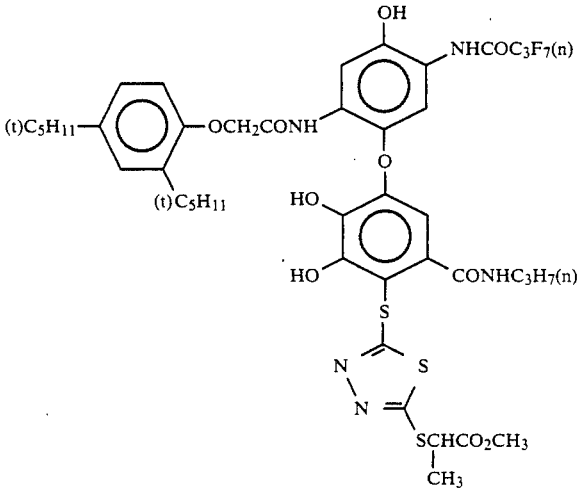
ExC-3
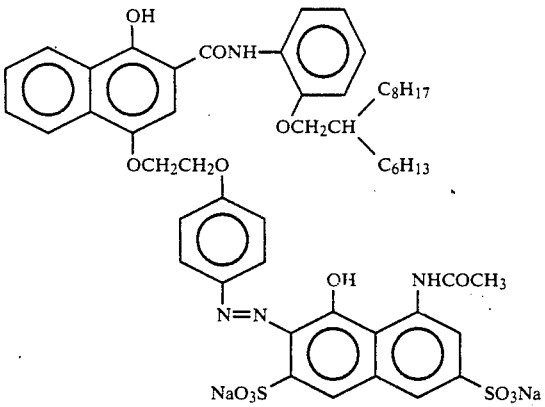
ExC-4
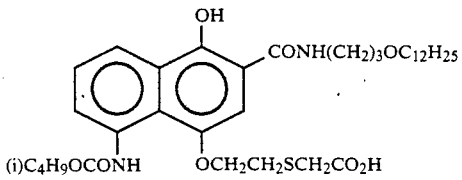

-continued
ExM-5
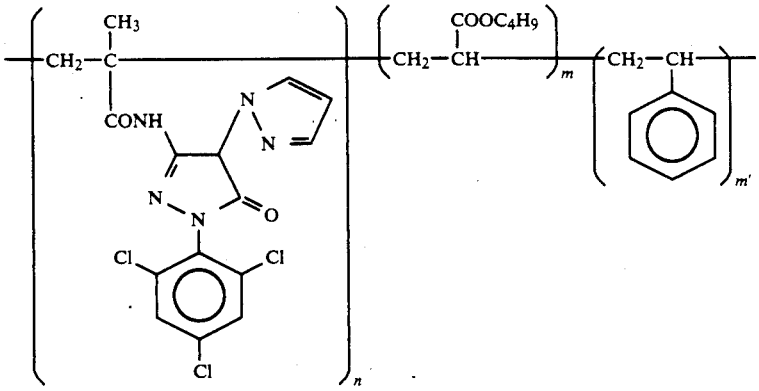
n = 50
m = 25
m' = 25
mol. wt. about 20,000
ExM-6
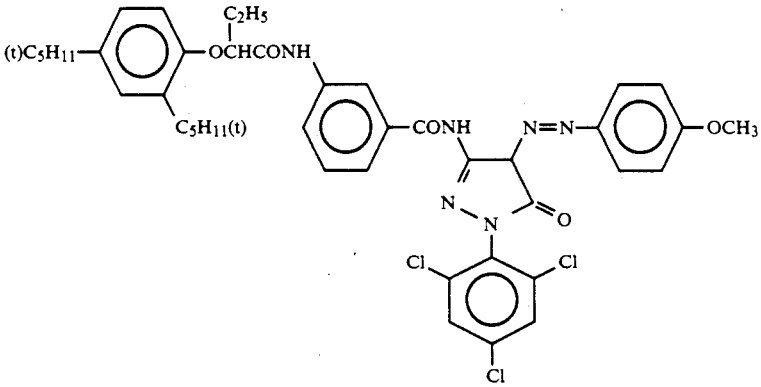
ExM-7
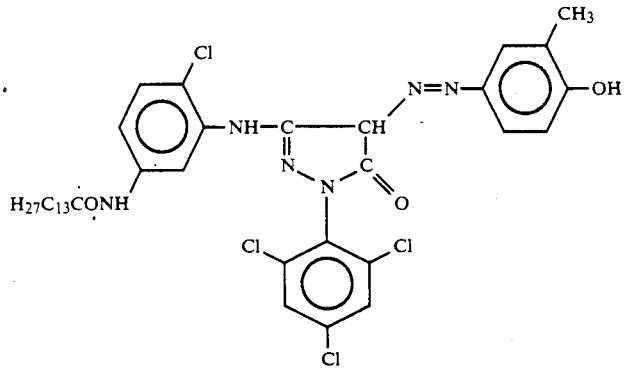
ExM-10
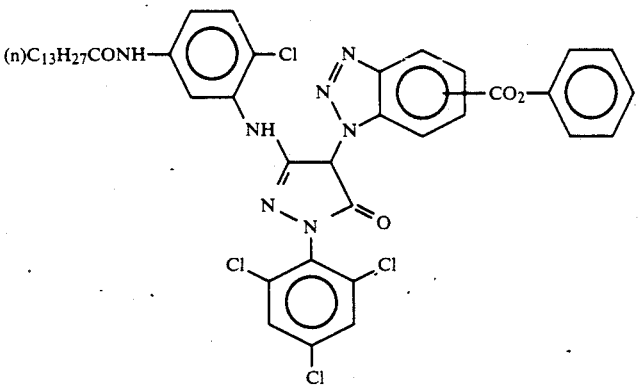

-continued
ExY-8
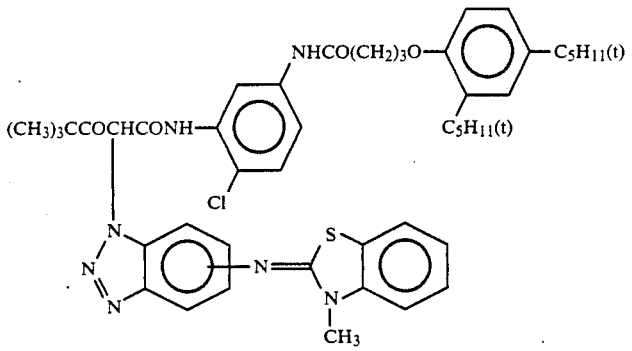
ExY-9
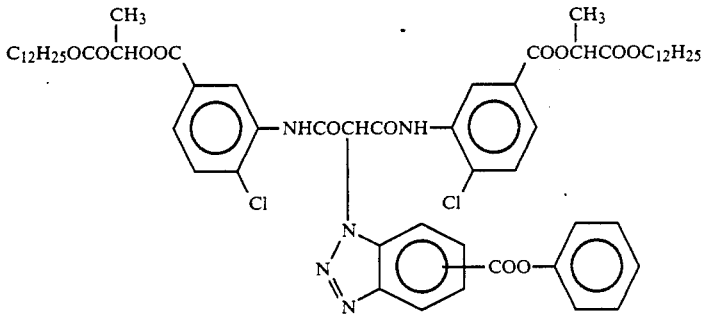
ExY-11
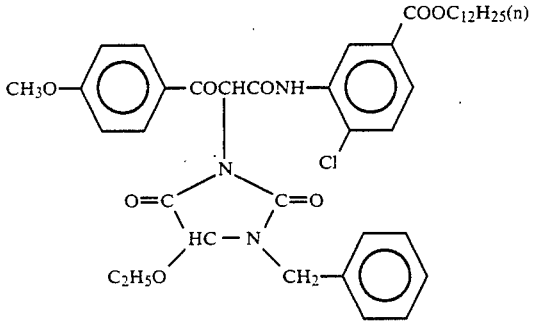
ExY-12
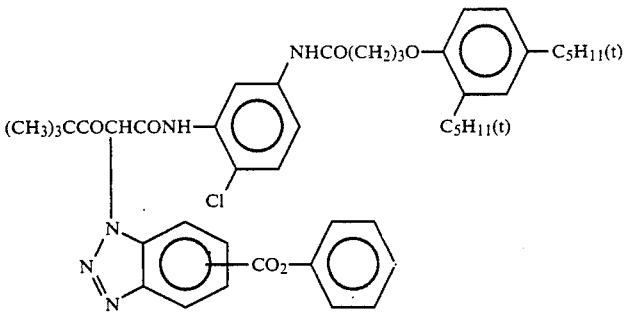
Cpd-7
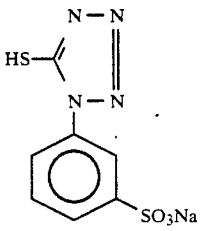

-continued

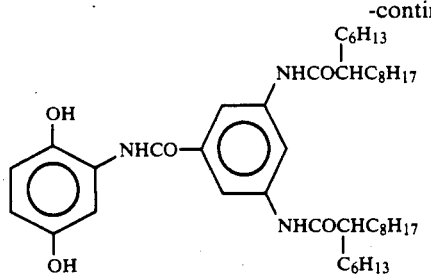

Cpd-1

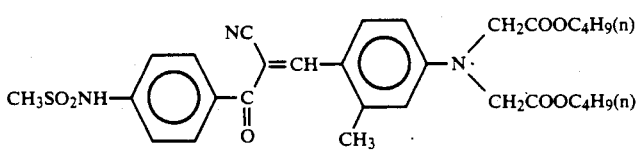

Cpd-2

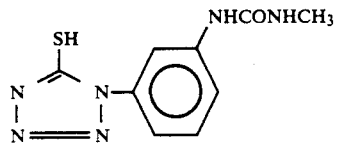

Cpd-6

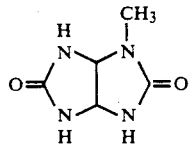

Cpd-5

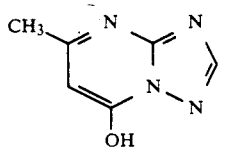

Cpd-3

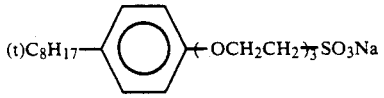

Cpd-4

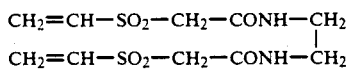

H-1

Sample 32 was prepared in the same manner as described above for Sample 31 except for mixing an aqueous Polymer latex (P-2) according to the present invention in a ratio of 0.8 by weight (as polymer component) based on the cyan coupler with the coupler emulsion and the silver halide emulsion in the preparation of the red-sensitive layers, i.e., the second layer, third layer and fourth layer, respectively.

Samples 33 to 35 were prepared using the equal weight (as polymer component) of Polymer latex (P-12) according to the present invention and comparative polymers 1 and 2 as described in Table 5 below in place of Polymer latex (P-2) used in Sample 32, respectively.

Samples 31 to 35 thus-prepared were cut into 35 m/m width strips, exposed wedgewise to white light and then subjected to development processing according to the following processing steps.

TABLE 7

| Processing Step | Processing Temperature (°C.) | Processing Time | Amount of* Replenishment (ml) | Capacity of Tank (l) |
|---|---|---|---|---|
| Color Development | 37.8 | 3 min. 15 sec. | 21 | 5 |
| Bleaching | 38.0 | 45 sec. | 45 | 2 |
| Fixing (1) | 38.0 | 45 sec. | Two-tank countercurrent system | 2 |
| Fixing (2) | 38.0 | 45 sec. | 30 | 2 |

TABLE 7-continued

| Processing Step | Processing Temperature (°C.) | Processing Time | Amount of* Replenishment (ml) | Capacity of Tank (l) |
|---|---|---|---|---|
| Stabilizing (1) | 38.0 | 20 sec. | Three-tank countercurrent system | 1 |
| Stabilizing (2) | 38.0 | 20 sec. | | 1 |
| Stabilizing (3) | 38.0 | 20 sec. | 35 | 1 |
| Drying | 55 | 1 min. 00 sec. | | |

*Amount of replenishment per 1 meter of 35 m/m width strip

In the fixing tank of the automatic developing machine used, a jet stirrer as described in JP-A-62-183460, page 3 was used, and the light-sensitive material was processed in a manner such that the jet of the fixing solution struck the surface of the light-sensitive material.

The composition of each processing solution used is illustrated below.

| | Mother Solution | Replenisher |
|---|---|---|
| Color Developing Solution: | | |
| Hydroxyethyliminodiacetic Acid | 5.0 g | 6.0 g |
| Sodium Sulfite | 4.0 g | 5.0 g |
| Potassium Carbonate | 30.0 g | 37.0 g |
| Potassium Bromide | 1.3 g | 0.5 g |
| Potassium Iodide | 1.2 mg | — |
| Hydroxylamine Sulfate | 2.0 g | 3.6 g |
| 4-(N-Ethyl-N-β-hydroxyethylamino)-2-methylaniline Sulfate | $1.0 \times 10^{-2}$ mol | $1.0 \times 10^{-2}$ mol |
| Water to make | 1.0 l | 1.0 l |
| ph | 10.00 | 10.15 |
| Bleaching Solution: | | |
| Ferric Complex of 1,3-Diaminopropanetetraacetic Acid | 130 g | 190 g |
| 1,3-Diaminopropanetetraacetic Acid | 3.0 g | 4.0 g |
| Ammonium Bromide | 85 g | 120 g |
| Acetic Acid | 50 ml | 70 ml |
| Ammonium Nitrate | 30 g | 40 g |
| Water to make | 1.0 l | 1.0 l |
| pH | 4.3 | 3.5 |

The pH was adjusted with acetic acid and aqueous ammonia.

| Fixing Solution: | Mother Solution | Replenisher |
|---|---|---|
| 1-Hydroxyethylidene-1,1-diphosphonic Acid | 5.0 g | 7.0 g |
| Disodium Ethylenediaminetetraacetate | 0.5 g | 0.7 g |
| Sodium Sulfite | 10.0 g | 12.0 g |
| Sodium Bisulfite | 8.0 g | 10.0 g |
| Aqueous Solution of Ammonium Thiosulfate (700 g/l) | 170.0 ml | 200.0 ml |
| Ammonium Thiocyanate | 100.0 g | 150.0 g |
| 3,6-Dithia-1,8-octanediol | 3.0 g | 5.0 g |
| Water to make | 1.0 l | 1.0 l |
| pH | 6.5 | 6.7 |

The pH was adjusted with acetic acid and aqueous ammonia.

| Stabilizing Solution: (both mother solution and replenisher) | |
|---|---|
| Formalin (37%) | 1.2 ml |
| 5-Chloro-2-methyl-4-isothiazolin-3-one | 6.0 mg |
| 2-Methyl-4-isothiazolin-3-one | 3.0 mg |
| Surface Active Agent $C_{10}H_{21}—O(—CH_2CH_2O—)_{10}H$ | 0.4 g |
| Ethylene Glycol | 1.0 g |
| Water to make | 1.0 l |
| pH | 5.0 to 7.0 |

The change in photographic performance of the samples were evaluated in the same manner described in Examples 1 and 2.

The results obtained are shown in Table 5 below.

Using the samples processed before the continuous processing, fastness of color image was evaluated upon preservation under a temperature of 100° C. for 7 days. Then, increase in yellow density ($\Delta D_T$) in the red-sensitive layer of each sample was measured.

The results obtained are also shown in Table 5 below.

TABLE 5

| | | Change in Photographic Performance | | | |
|---|---|---|---|---|---|
| Sample | Polymer | Sensitivity ($\Delta_S$) | Decrease in Density (D%) | $\Delta D_T$ | Remark |
| 31 | — | −0.10 | 8 | 0.15 | Comparison |
| 32 | P-3 | −0.03 | 2 | 0.03 | Invention |
| 33 | P-5 | −0.03 | 2 | 0.03 | " |
| 34 | P-9 | −0.03 | 2 | 0.03 | " |
| 35 | P-11 | −0.03 | 2 | 0.04 | " |
| 36 | P-16 | −0.04 | 3 | 0.03 | " |
| 37 | P-17 | −0.03 | 2 | 0.03 | " |
| 38 | P-21 | −0.03 | 2 | 0.03 | " |
| 39 | P-25 | −0.04 | 3 | 0.04 | " |
| 40 | Comparative polymer 1 | −0.14 | 11 | 0.17 | Comparison |
| 41 | Comparative polymer 2 | −0.13 | 8 | 0.14 | " |

From the results shown in Table 5 above, it can be seen that the change in photographic performance can be decreased and the increase in yellow density (stain) due to heat can be remarkably depressed using the polymer according to the present invention.

As described above, it is clear that the change is photographic performance (sensitivity and color density) during continuous processing is small in the case of using the polymer according to the present invention. Furthermore, the use of the polymer according to the present invention is apparently effective for preventing light stain due to light exposure for a long periods of time and stain which occurs upon preservation at high temperatures.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one silver halide emulsion layer obtained by coating a mixture containing (i) a dispersion comprising a cyan dye forming coupler dissolved in a high boiling point solvent; (ii) a silver halide emulsion; and (iii) an aqueous polymer latex solution, said aqueous polymer latex solution comprising from 70 to 100% by weight of monomer units of a monomer represented by the following general formula (A):

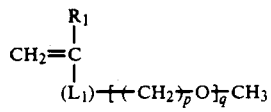

(A)

wherein $R_1$ represents a hydrogen atom or an alkyl group having from 1 to 4 carbon atoms; $L_1$ represents —CONH— or

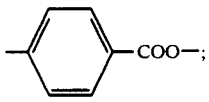

p represents an integer of from 1 to 4; and q represents an integer of from 1 to 30; and up to 30% by weight of monomer units of a monomer represented by the following general formula (B):

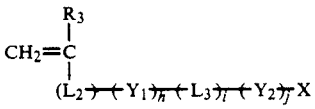

(B)

wherein $R_2$ represents a hydrogen atom or an alkyl group having from 1 to 4 carbon atoms; $L_2$ represents —COO— or —CONH— or a phenylene group; $L_3$ represents —OCO—, —COO—, —NHCO— or —CONH—; $Y_1$ and $Y_2$ each represents a straight chain or branched chain alkylene group having from 1 to 12 carbon atoms; and h, i and j each represent 0 or 1, when j is 0, X represents a hydrogen atom or an alkali metal atoms and when j is 1, X represents —COOH—, —$SO_3H$, —$OPO(OH)_2$ or a metal salt thereof.

2. A silver halide color photographic material according to claim 1, wherein the monomer is represented by general formula (A) and $R_1$ is a hydrogen atom or a methyl group.

3. A silver halide color photographic material according to claim 1, wherein the monomer is represented by general formula (A) and p is an integer of from 1 to 3.

4. A silver halide color photographic material according to claim 1, wherein the monomer is represented by general formula (A) and q is an integer of from 1 to 10.

5. A silver halide color photographic material according to claim 1, wherein $R_2$ in general formula (B) is a hydrogen atom or a methyl group.

6. A silver halide color photographic material according to claim 1, wherein $L_3$ in general formula (B) is —OCO— or —NHCO—.

7. A silver halide color photographic material according to claim 1, wherein $Y_1$ and $Y_2$ in general formula (B) each represents a methylene group, an ethylene group or a propylene group.

8. A silver halide color photographic material according to claim 1, wherein X in general formula (B) is a hydrogen atom, when j is 0.

9. A silver halide color photographic material according to claim 1, wherein X in general formula (B) is —COOH or —$SO_3H$, when j is 1.

10. A silver halide color photographic material according to claim 1, wherein the cyan dye forming coupler is a naphthol cyan coupler or a phenol cyan coupler.

11. A silver halide color photographic material according to claim 10, wherein the coupler is a naphthol cyan coupler represented by the following general formula (I):

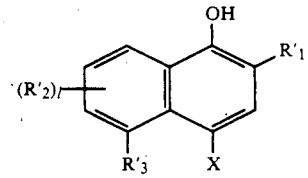

(I)

wherein $R'_1$ of formula (I) represents —$CONR_4R_5$, —$NHCOR_4$, —$NHCOOR_6$, —$NHSO_2R_6$, —$NHCONR_4R_5$ or —$NHSO_2NR_4R_5$ (wherein $R_4$ and $R_5$, which may be the same or different, each represents a hydrogen atom, an aliphatic group, an aromatic group or a heterocyclic group; and $R_6$ represents an aliphatic group, an aromatic group or a heterocyclic group); $R'_2$ of formula (I) represents a group capable of being substituted on the naphthalene ring, l represents an integer of from 0 to 3; $R'_3$ of formula (I) represents a hydrogen atom or a monovalent organic group; and X represents a hydrogen atom or a group capable of being released upon a coupling reaction with an oxidation product of an aromatic primary amine developing agent.

12. A silver halide color photographic material according to claim 11, wherein the monovalent organic group represented by $R_3$ of formula (I) is a group represented by the following general formula (I-1):

$$R_7(Y)_m—NH \qquad \text{(I-1)}$$

wherein Y represents

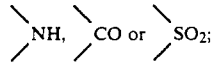

m represents 0 or 1; and $R_7$ represents a hydrogen atom, an aliphatic group having from 1 to 30 carbon atoms, an aromatic group having from 6 to 30 carbon atoms, a heterocyclic group having from 2 to 30 carbon atoms, —$OR_8$, —$COR_8$,

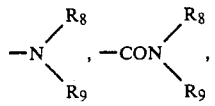

—PO—$(OR_{10})_2$, —PO—$(R_{10})_2$,

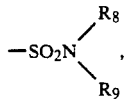

—$CO_2R_{10}$, —$SO_2R_{10}$ or —$SO_2OR_{10}$ wherein $R_8$, $R_9$ and $R_{10}$ each has the same meaning as defined for $R_4$, $R_5$ and $R_6$ respectively.

$R_4$ and $R_5$ in

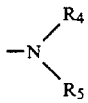

for $R_1$ or $R_8$ and $R_9$ in

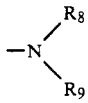

for $R_7$ may combine with each other to form a nitrogen-containing heterocyclic ring.

13. A silver halide color photographic material according to claim 11, wherein the coupling releasing group represented by X is a halogen atom, —OR', —SR',

—OC(=O)R', —NHCOR', —NHC(=O)SR', —OC(=O)R', —OC(=O)NHR' wherein R' represents an aliphatic group having from 1 to 30 carbon atoms, an aromatic group having from 6 to 30 carbon atoms or a heterocyclic group having from 2 to 30 carbon atoms, an aromatic azo group having from 6 to 30 carbon atoms, or a heterocyclic group which has from 1 to 30 carbon atoms and is connected to the coupling active position of the coupler through a nitrogen atom therein.

14. A silver halide color photographic material according to claim 10, wherein the coupler is a phenol cyan coupler and is represented by the following general formula (II):

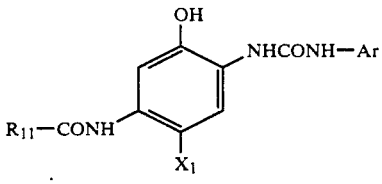

(II)

wherein $R_1$ represents an aliphatic group, an aromatic group or a heterocyclic group; Ar represents an aromatic group; and $X_1$ represents a hydrogen atom or a group capable of being released upon a coupling reaction with an oxidation product of an aromatic primary amine developing agent.

15. A silver halide color photographic material according to claim 10, wherein the coupler is a phenol cyan coupler and is represented by general formula (III) or (IV):

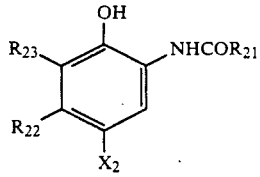

(III)

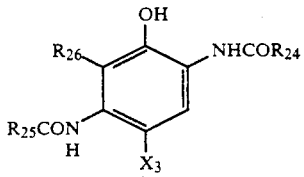

(IV)

wherein $R_{21}$, $R_{24}$ and $R_{25}$ each represent an aliphatic group, an aromatic group, a heterocyclic group, or a heterocyclic amino group; $R_{22}$ represents an aliphatic group; $R_{23}$ and $R_{26}$ each represent a hydrogen atom, a halogen atom, an aliphatic group, an aliphatic oxy group or an acylamino group; and $X_2$ and $X_3$ each represent a hydrogen atom or a group capable of being release upon a coupling reaction with an oxidation product of a developing agent, or $R_{22}$ and $R_{23}$ or $R_{25}$ and $R_{26}$ may combine with each other to form a 5-membered, 6-membered or 7-membered ring.

16. A silver halide color photographic material according to claim 1, wherein the silver halide emulsion layer is a red-sensitive silver halide emulsion layer.

17. A silver halide color photographic material according to claim 1, wherein the polymer latex comprises from 80 to 100% by weight of a monomer of formula (A) and up to 20% by weight of a monomer of formula (B).

18. A silver halide color photographic material according to claim 17, wherein the polymer latex comprises from 80 to 100% by weight of a monomer of formula (A) and from 2 to 10% by weight of a monomer of formula (B).

19. A silver halide color photographic material according to claim 1, wherein the amount of cyan coupler ranges from 0.001 to 1 mole/mole of photosensitive silver halide on the same layer.

20. A silver halide color photographic material according to claim 1, wherein the amount of polymer latex ranges from 3 to 300% by weight based on the cyan coupler.

21. A silver halide color photographic material according to claim 20, wherein the amount of polymer latex ranges from 10 to 250% by weight based on the cyan coupler.

22. A silver halide color photographic material according to claim 21, wherein the amount of polymer latex ranges from 20 to 200% by weight based on the cyan coupler.

* * * * *